US009372448B2

(12) United States Patent
Hasegawa

(10) Patent No.: US 9,372,448 B2
(45) Date of Patent: Jun. 21, 2016

(54) IMAGE HEATING APPARATUS

(71) Applicant: CANON KABUSHIKI KAISHA, Tokyo (JP)

(72) Inventor: Takuya Hasegawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/638,346

(22) Filed: Mar. 4, 2015

(65) Prior Publication Data

US 2015/0261150 A1 Sep. 17, 2015

(30) Foreign Application Priority Data

Mar. 14, 2014 (JP) ..... 2014-051387

(51) Int. Cl.
*G03G 15/20* (2006.01)

(52) U.S. Cl.
CPC ..... *G03G 15/2039* (2013.01); *G03G 15/2032* (2013.01); *G03G 15/2053* (2013.01); *G03G 2215/2019* (2013.01)

(58) Field of Classification Search
CPC ..... G03G 15/2039; G03G 15/205; G03G 15/2042; G03G 2215/2035; G03G 15/2078
USPC ..... 399/69
See application file for complete search history.

(56) References Cited

U.S. PATENT DOCUMENTS 7,711,306 B2 5/2010 Kagawa
2004/0190958 A1* 9/2004 Matsumoto ..... G03G 15/2032 399/329
2005/0214043 A1* 9/2005 Kameda ..... G03G 15/2017 399/328

(Continued)

FOREIGN PATENT DOCUMENTS

| | | |
|---|---|---|
| JP | 2003-084616 | 3/2003 |
| JP | 2007-212896 A | 8/2007 |
| JP | 2010-175721 | 8/2010 |

OTHER PUBLICATIONS

Machine translation of JP 11-149229 A, publication date: 1992.*

(Continued)

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

An image heating apparatus includes: first and second rollers; an external heating unit including a heating belt, first and second supporting rollers for urging the belt toward the first roller, an urging member for urging the first supporting roller away from the second supporting roller, a holder for the first and second supporting rollers and for permitting movement of the first supporting roller relative to the second supporting roller, and a temperature sensor, provided interposing the belt between itself and the first supporting roller; and a moving mechanism for moving the unit between a first position where the belt contacts the first roller and a second position where the belt does not. The temperature sensor is disposed such that the detected temperature at a predetermined position between the first position and the second position is higher than those at the first position and the second position.

12 Claims, 15 Drawing Sheets

(56) References Cited

U.S. PATENT DOCUMENTS

| | | | | |
|---|---|---|---|---|
| 2007/0189817 | A1 | 8/2007 | Kagawa | |
| 2007/0264059 | A1* | 11/2007 | Maeda | G03G 15/2025 399/320 |
| 2013/0051875 | A1 | 2/2013 | Takahashi | |
| 2013/0209145 | A1 | 8/2013 | Hasegawa | |
| 2014/0086647 | A1 | 3/2014 | Hasegawa | |
| 2014/0093287 | A1 | 4/2014 | Hasegawa | |
| 2014/0153947 | A1 | 6/2014 | Hasegawa | |
| 2014/0153981 | A1 | 6/2014 | Hasegawa | |
| 2014/0224623 | A1 | 8/2014 | Hasegawa | |
| 2014/0226998 | A1 | 8/2014 | Hasegawa | |

OTHER PUBLICATIONS

European Search Report dated Jul. 15, 2015 in corresponding EP Application No. 15158151.9.

* cited by examiner (a)

(b)

| | THERMISTOR POSITION (mm) | | | | | | | | |
|---|---|---|---|---|---|---|---|---|---|
| | -2.0 | -1.5 | -1.0 | -0.5 | 0.0 | 0.5 | 1.0 | 1.5 | 2.0 |
| DETECTED TEMP (°C) | 188.2 | 192.1 | 196.5 | 199.2 | 200.0 | 199.1 | 195.7 | 191.0 | 186.5 |

FIG.11

IMAGE HEATING APPARATUS

FIELD OF THE INVENTION AND RELATED ART

The present invention relates to an image heating apparatus (device) which heats a toner image on a sheet of recording medium.

In recent years, it has come to be required for image forming apparatuses such as a copying machine, a printer, and multifunction image forming apparatus to be higher in speed and image quality, capable of forming color images, lower in energy consumption, capable of dealing with various recording media (which hereafter may be referred to as sheet of paper), such as sheet of cardstock, coarse paper, embossed paper, coated paper, etc., and also, higher in productivity (output in terms of print count per unit length of time).

For the purpose of increasing an electrophotographic image forming apparatus in productivity, in particular, when recording medium used for image formation is a sheet of recording medium which is large in basis weight (cardstock, for example), it is desired to increase its fixing device (image heating device) in heating performance.

In a case where cardstock is used as recording medium, the fixation roller (rotational member) is robbed of a substantial amount of heat, and therefore, reduces in surface temperature. Thus, it is possible that fixation failure will occur.

Thus, there has been proposed an external heating system for externally heating a fixation roller (Japanese Laid-open Patent Application 2007-212896). This external heating system is provided with a pair of supporting rollers, and an external heating belt which is suspended by the pair of rollers. It is structured so that the external heating belt is placed in contact with the peripheral surface of the fixation roller to heat the fixation roller.

In a case where an external heating belt is employed by a fixing device (image heating device) as described above, the fixing device is desired to be structured so that in order to make it possible for the pair of supporting rollers which support the external heating belt, to be varied in the distance between the two, one or both supporting rollers are made movable, and kept under the pressure generated in the direction to increase the distance between the two, to provide the external heating belt with tension.

However, in a case where the external heating system is structured so that the supporting rollers are made to play the role of tension rollers, that is, to provide the external heating belt with tension, as the external heating belt is placed in contact with, or moved away from, the fixation roller, the supporting rollers are made to move. Thus, the thermistor for detecting the temperature of the supporting roller, which is pressed against the supporting roller, with the presence of the external heating belt between itself and supporting roller, changes in its portion by which it contacts the external heating belt (supporting roller).

Thus, the difference between the actual temperature of the external heating belt, and the temperature detected by the thermistor when the external heating belt is in contact with the fixation roller is substantially different from that when the external heating belt is in its retreat position.

SUMMARY OF THE INVENTION

According to an aspect of the present invention, there is provided a An image heating apparatus comprising first and second rotatable members forming therebetween a nip for heating a toner image on a recording material; an external heating unit including an external heating belt for externally heating said first rotatable member, first and second supporting rollers for rotatably supporting said external heating belt at an inner surface thereof and for urging said external heating belt toward said first rotatable member, an urging member for urging said first supporting roller in a direction away from said second supporting roller, a holding mechanism for rotatably holding said first and second supporting rollers and for permitting relative movement of said first supporting roller relative to said second supporting roller, and a temperature detecting element, provided interposing said external heating belt between itself and said first supporting roller, for detecting a temperature of said external heating belt; and a moving mechanism for moving said external heating unit between a first position in which said external heating belt contacts said first rotatable member and a second position in which said external heating belt is away from said first rotatable member, wherein said temperature detecting element is disposed such that in a state that a temperature of said external heating belt is maintained at a predetermined temperature, a detected temperature at a predetermined position between the first position and the second position is higher than detected temperatures at the first position and the second position.

According to another aspect of the present invention, there is provided a An image heating apparatus comprising first and second rotatable members forming therebetween a nip for heating a toner image on a recording material; an external heating unit including an external heating belt for externally heating said first rotatable member, first and second supporting rollers for rotatably supporting said external heating belt at an inner surface thereof and for urging said external heating belt toward said first rotatable member, an urging member for urging said first supporting roller in a direction away from said second supporting roller, a holding mechanism for rotatably holding said first and second supporting rollers and for permitting relative movement of said first supporting roller relative to said second supporting roller, and a temperature detecting element, provided interposing said external heating belt between itself and said first supporting roller, for detecting a temperature of said external heating belt; and a moving mechanism for moving said external heating unit between a first position in which said external heating belt contacts said first rotatable member and a second position in which said external heating belt is away from said first rotatable member, wherein said temperature detecting element is disposed so that a portion of said temperature detecting element where a detection sensitivity thereof is maximum contacts said external heating belt when said external heating belt is at a predetermined position between the first position and the second position.

Further features of the present invention will become apparent from the following description of exemplary embodiments with reference to the attached drawings.

BRIEF DESCRIPTION OF THE DRAWINGS

FIG. 11 is a table which shows the relationship between the point of an object, which a thermistor contacts, and the temperature detected by the thermistor.

DESCRIPTION OF THE PREFERRED EMBODIMENTS

Hereinafter, the present invention is concretely described with reference to one of preferred embodiments of the present invention. This embodiment is not intended to limit the present invention in scope, although it is an example of the best embodiment of the present invention.

Embodiment

Structure of Image Forming Apparatus

Figure 2:
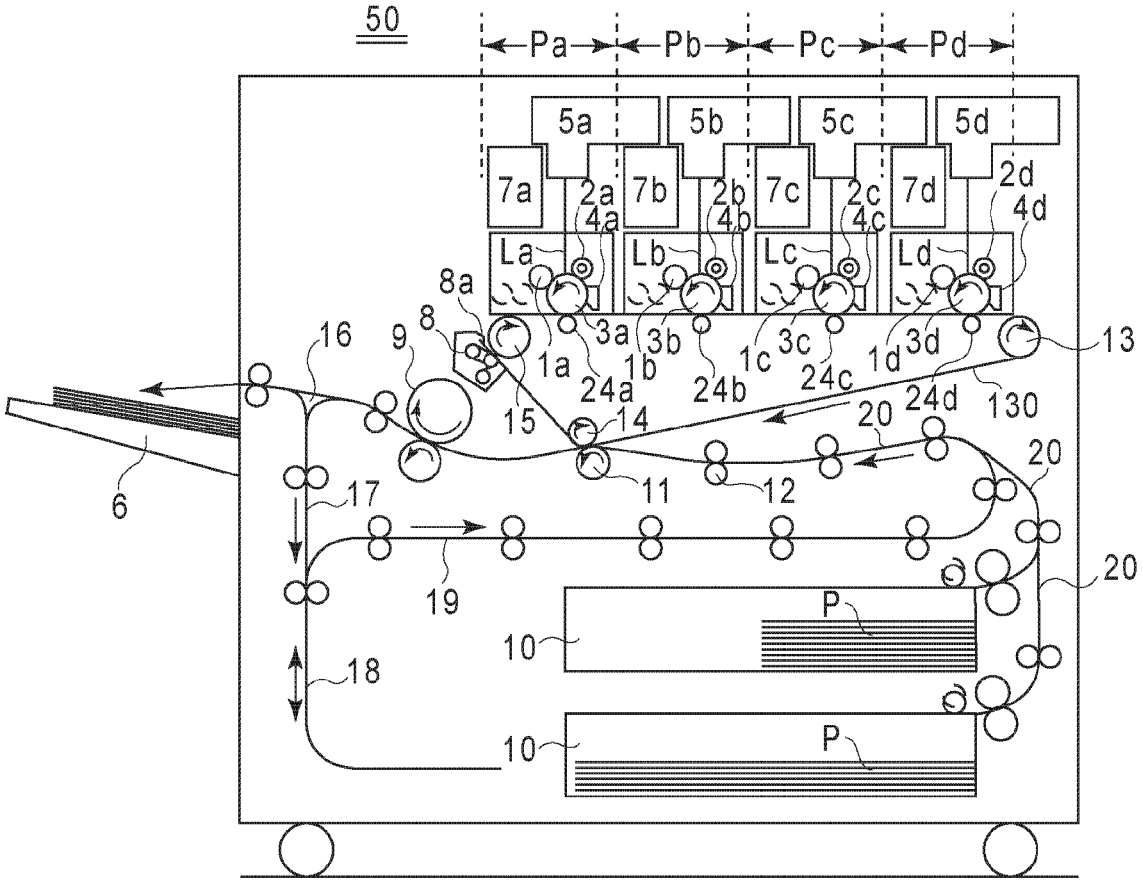
FIG. 2 is a schematic sectional view of the image forming apparatus an embodiment of the present invention, and shows the general structure of the apparatus.

FIG. 2 is a schematic drawing of the image forming apparatus 50 in this embodiment. It shows the general structure of the apparatus 50. This image forming apparatus 50 is an electrophotographic color laser beam printer of the inline type, and also, of the intermediary transfer belt type. It is equipped with a fixing device 9 having an external heating belt. More concretely, it has the first, second, third, and fourth image forming sections Pa, Pb, Pc and Pd, in its main assembly, to form four monochromatic toner images, which are different in color, through an electrophotographic process which includes a latent image forming process, a developing process, and a transferring process.

The image forming sections Pa, Pb, Pc and Pd have their own image bearing member, that is, electrophotographic photosensitive drum 3 (3*a*, 3*b*, 3*c* and 3*d*, respectively). Each photosensitive drum 3 is rotationally driven at a preset peripheral velocity in the counterclockwise direction indicated by an arrow mark. The image forming apparatus 50 is provided with drum charging devices 2 (2*a*, 2*b*, 2*c* and 2*d*), developing devices 1 (1*a*, 1*b*, 1*c*, and 1*d*), primary transfer charging devices 24 (24*a*, 24*b*, 24*c* and 24*d*), and cleaners 4 (4*a*, 4*b*, 4*c* and 4*d*), which are disposed in the adjacencies of the peripheral surfaces of the corresponding photosensitive drums 3, respectively. Each photosensitive drum 3 is uniformly charged to a preset polarity and a preset potential level by the corresponding drum charging device 2.

Further, the image forming sections P (Pa, Pb, Pc and Pd) are provided with their own exposing devices (laser scanners) 5 (5*a*, 5*b*, 5*c* and 5*d*), respectively. Each exposing device 5 has a light source (unshown), and a polygon mirror (unshown). A beam L of laser light outputted from the light source is deflected by a deflection mirror, and then, is deflected by a polygon mirror in such a manner that it oscillates. Then, the beam L is focused on the generatrix of the corresponding photosensitive drum 3; the peripheral surface of the photosensitive drum 3 is exposed by the beam L. As a result, a latent image, which corresponds to image formation signals, is effected on the charged photosensitive drum 3.

When the developing devices 1*a*, 1*b*, 1*c* and 1*d* are brand-new, they contain cyan, magenta, yellow and black toners, respectively, by a preset amount (initially). As they are used for development, they are replenished with cyan, magenta, yellow, and black toners, by toner supplying devices 7 (7*a*, 7*b*, 7*c* and 7*d*), in order to keep the developing devices 1 stable in the amount of toner. Each developing device 1 develops the latent image on the photosensitive drum 3 into a visible image, that is, image formed of toner (which hereafter will be referred to simply as toner image (cyan, magenta, yellow or black toner image).

The image forming apparatus 50 is provided with an intermediary transfer belt 130, which is disposed so that it is in the adjacencies of the bottom side of each photosensitive drum 3. The intermediary transfer belt 130 is suspended, and kept tensioned, by a driving roller 13, a belt-backing roller 14, and a tension roller 15. It is rotationally driven in the clockwise direction indicated by another arrow mark, at the same peripheral velocity as the photosensitive drum 3.

The four monochromatic toner images, different in color, formed on four photosensitive drums 3, one for one, are sequentially transferred (primary transfer) in layers onto the intermediary transfer belt 130. Consequently, a full-color toner image is synthetically effected on the intermediary transfer belt 130. The belt-backing roller 14 opposes the secondary transfer roller 11 with the presence of the intermediary transfer belt 130 between the two rollers 14 and 11. The nip (area of contact) between the intermediary transfer belt 130 and secondary transfer roller 11 is the secondary transferring section, in which the four monochromatic toner images, of which the full-color toner image is made up, are transferred together (secondary transfer) onto a sheet P of recording medium (which hereafter may be referred to as sheet P of paper).

The transfer (primary transfer) of a toner image from a photosensitive drum 3 onto the intermediary transfer belt 130 is done by the electric field formed by the primary transfer bias applied to the primary transfer charging device 24, and the pressure in the primary transfer nip. After the completion of the primary transfer, the toner remaining on each photosensitive drum 3 is removed by the corresponding cleaner 4, being thereby prepared for the formation of the next latent image.

As for the secondary transfer, the synthetic full-color toner image on the intermediary transfer belt 130 is transferred (secondary transfer) onto a sheet P of paper by the application of a preset secondary transfer bias to the secondary transfer roller 11 by the secondary transfer bias source. Residues, such as the transfer residual toner, which are remaining on the intermediary transfer belt 130 after the secondary transfer, are wiped away by the cleaning web 8*a* (unwoven cloth) of the cleaner 8, which is placed in contact with the surface of the intermediary transfer belt 130, in the area in which the intermediary transfer belt 130 is supported by the tension roller 15.

As for the conveyance of a sheet P of paper to the secondary transferring section, the sheet feeding mechanism of one of the two vertically stacked sheet feeder cassettes 10 is activated to feed a sheet P of paper into the main assembly of the image forming apparatus 50 while separating the sheet P from the rest. Then, the sheet P is conveyed to the secondary transferring section, with a preset timing, through a recording medium conveyance passage 20. Then, the sheet P is conveyed further through a pair of registration rollers 12, and a pre-transfer guide (unshown). At the same time, the secondary transfer bias is applied to the secondary transfer roller 11 from the bias power source. Thus, the synthetic full-color toner image is transferred (secondary transfer) from the intermediary transfer belt 130 onto the sheet P. After the transfer of the toner image onto the sheet P in secondary transferring section, the sheet P is introduced into the fixing device 9, in which it is subjected to heat and pressure to fix the toner image thereon. The detailed description of the fixing device 9 is given later.

When the image forming apparatus 50 is in the one-sided printing mode, after the sheet P of paper is discharged from the fixing device 9, it is conveyed through the recording medium conveyance passage, which is on the top side of the flapper 16 while the flapper 16 is in the first attitude. Then, it is discharged as a one-sided print into a delivery tray 6, which is outside the main assembly of the image forming apparatus 50.

When the image forming apparatus 50 is in the two-sided printing mode, after a sheet P of paper having a toner image on one of its two surfaces is moved out of the fixing device 9, it is introduced into a reversal passage 17 by the flapper 16 which is in the second attitude. Then, it is introduced into a switchback passage 18. Then, it is conveyed from the switchback passage 18 into a two-sided printing mode passage 19.

Then, the sheet P of paper is reintroduced into the recording medium conveyance passage 20 from the two-sided printing passage 19, and introduced into the secondary transferring section with a preset control timing through the pair of registrations 12, and pre-transfer guide, while remaining upside down. Then, while the sheet P is conveyed through the secondary transferring section, a toner image is transferred (secondary transfer) onto the second surface of the sheet P. Then, the sheet P is reintroduced into the fixing device 9, is conveyed through the recording medium conveyance passage, which is on the top side of the flapper 16 which is in the first attitude into which it was moved back, and then, is discharged as a two-sided print into the delivery tray 6.

[Fixing Device]

Next, the fixing device 9 in this embodiment, which is an image heating device having an external heating belt, is described in detail about its structure. In the following description of the fixing device 9, "front side (front surface side)" of the fixing device 9 means the side of the fixing device 9, from which a sheet P of paper is introduced into the fixing device 9. "Rear side" means the opposite side from the front side. "Left and right" of the fixing device 9 means the left and right sides of the fixing device 9 as seen from the front side. "Top and bottom" sides of the fixing device 9 means the top and bottom in terms of the gravity direction. "Lengthwise direction (widthwise direction)" of the fixing device 9, and components thereof, means the direction which is parallel to the axial line (thrust direction) of any of rotational members of the fixing device 9, direction which is perpendicular to the direction in which a sheet P of paper is conveyed through the recording medium conveyance passage, or direction which is practically parallel to the direction perpendicular to the recording medium conveyance direction.

Figure 1:
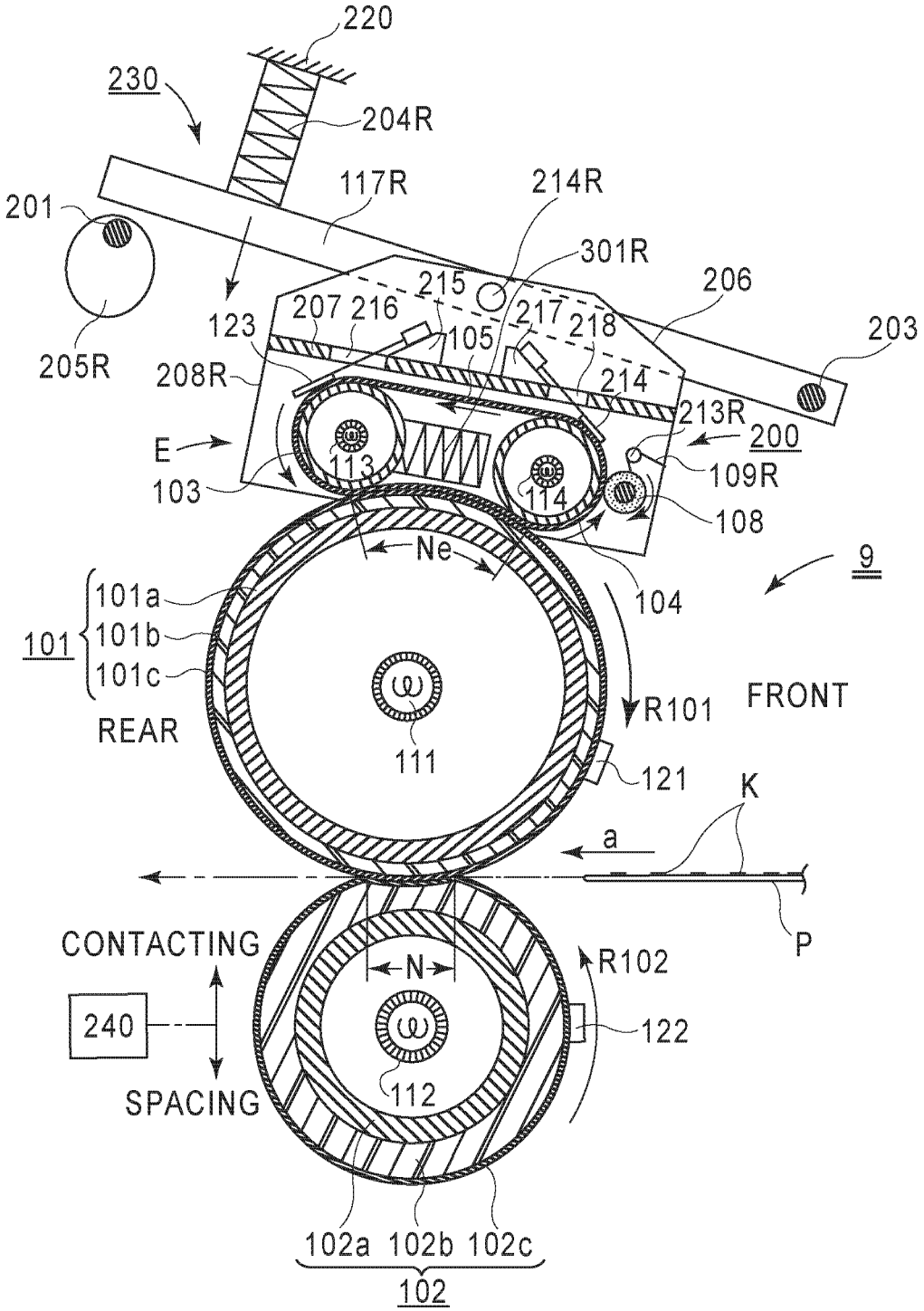
FIG. 1 is a schematic sectional view of the fixing device having an external heating system in the first embodiment of the present invention, and shows the general structure of the device.

FIG. 1 is a schematic cross-sectional view of the essential portions of the fixing device 9. This fixing device 9 has a fixation roller 101 (image heating member) and a pressure roller 102 (pressure applying member), as the first and second rotational members, respectively, for thermally fixing the toner image K on a sheet P of paper (recording medium), in the nip N (fixation nip) between the two rollers 101 and 102. Further, the fixing device 9 has an external heating unit 200 (external heating belt unit), which externally heats the fixation roller 101.

Further, the fixing device 9 has a mechanism 230 for moving the external heating unit 200 into the first position E in which the unit 200 keeps the external heating belt 105 of the external heating unit 200 in contact with the fixation roller 101, and the second position F (FIG. 3) in which the unit 200 keeps the external heating belt 105 separated from the fixation roller 101.

(1) Fixation Roller 101

The fixation roller 101 in this embodiment is a multilayered hollow roller. It is made up of a metallic core 101*a* which is a piece of metallic pipe, a heat resistant elastic layer 101*b* which is on the peripheral surface of the metallic core 101*a*, and a heat resistant parting layer 101*c* layered upon the elastic layer. There is disposed a halogen heater 111, as a heat source (heat generating member), in the hollow of the metallic core 101*a*. The left and right ends of the fixation roller 101 are rotatably supported by the left and right lateral plates 202L and 202R (FIG. 4), respectively, of the casing (device chassis) of the fixing device 9, with the placement of a pair of bearings (unshown) between the left and right ends of the fixation roller 101, one for one, in such a manner that the fixation roller 101 remains practically horizontal.

The fixation roller 101 is rotationally driven by a motor M1, as a driving force source, through a transmitting mechanism (unshown), at a preset peripheral velocity (process speed) in clockwise direction indicated by an arrow mark R101. The motor M1 is under the control of a motor controller 141 which is controlled by a control section 140 (CPU 201A). That is, as the motor driver 142 is turned on by the control section 140, the motor M1 drives the fixation roller 101, whereas as the motor driver 142 is turned off by the control section 140, the motor driver M1 stops driving the fixation roller 101.

The fixation roller 101 is internally heated by the halogen heater 111; as electric power is supplied to the halogen heater from a heater driver 144 (FIG. 5) through an electric power supply line (unshown), the halogen heater 111 generates heat. The surface temperature of the fixation roller 101 is detected by a thermistor 121, as a temperature detection element, which is in contact with the fixation roller 101. The electrical information related to the temperature detected by the thermistor 121 is inputted into the control section 140. The control section 140 controls the electric power supply to the halogen heater 111 by turning on or off the heater driver 144 through the heater controller 143, based on the inputted information, so that the surface temperature of the fixation roller 101 increases to a target level and remains at the target level.

(2) Pressure Roller 102

The pressure roller 102 in this embodiment is a multilayered hollow roller. It is made up of a metallic core 102*a* which is a piece of metallic pipe, a heat resistant elastic layer 102*b* which is on the peripheral surface of the metallic core 102*a*, and a heat resistant parting layer 102*c* layered upon the elastic layer 102*b*. There is disposed a halogen heater 112, as a heat source (heat generating member), in the hollow of the metallic core 102*a*. The pressure roller 102 is disposed under the fixation roller 101, being practically parallel to the fixation roller 101. The left and right ends of the pressure roller 102 are rotatably supported by the left and right lateral plates 202L and 202R (FIG. 4), respectively, of the casing of the fixing device 9, with the placement of a pair of bearings (unshown) between the left and right ends of the pressure roller 102, one for one.

The left and right bearings of the pressure roller 102 are disposed so that they can vertically slide relative to the lateral plates 202L and 202R, respectively. Further, they are movable upward or downward by a shifting mechanism which is controlled by the control section 140.

As the left and right bearings are moved upward by the shifting mechanism 240, the upwardly facing portion of the peripheral surface of the pressure roller 102 is pressed upon the downwardly facing portion of the peripheral surface of the fixation roller 101, by a preset amount of pressure (force), against the elasticity of the elastic layer 102*b*. Thus, a fixation N, which has a preset width in terms of the recording medium conveyance direction a, is formed between the fixation roller 101 and pressure roller 102. On the other hand, as the left and right bearings are moved downward by the shifting mechanism 240, the pressure roller 102 is moved away from the fixation roller 101, and is kept separated from the fixation roller 101.

As the fixation roller 101 is rotationally driven while the pressure roller 102 is in contact with the fixation roller 101, the pressure roller 102 is rotated by the rotation of the fixation roller 101 in the counterclockwise direction indicated by the arrow mark R102, at practically the same peripheral velocity as that of the fixation roller 101. Although the structure of the shifting mechanism 240 is not concretely shown in the drawings, the shifting mechanism 240 is made up of a driving force source such as an electromagnetic solenoid, which is controlled by the control section 140, levers, springs, cams, etc., for example.

The pressure roller 102 is internally heated by the halogen heater 112; as electric power is supplied to the halogen heater 112 from a heater driver 144 (FIG. 5) through an electric power supply line (unshown), the halogen heater 112 generates heat. The surface temperature of the pressure roller 102 is detected by a thermistor 122, as a temperature detection element, which is in contact with the pressure roller 102. The electrical information related to the temperature detected by the thermistor 122 is inputted into the control section 140. The control section 140 controls the electric power supply to the halogen heater 112 by turning on or off the heater driver 144 through the heater controller 143, based on the inputted information, so that the surface temperature of the pressure roller 102 increases to a target level and remains at the target level.

(3) External Heating Unit 200

Figure 3:
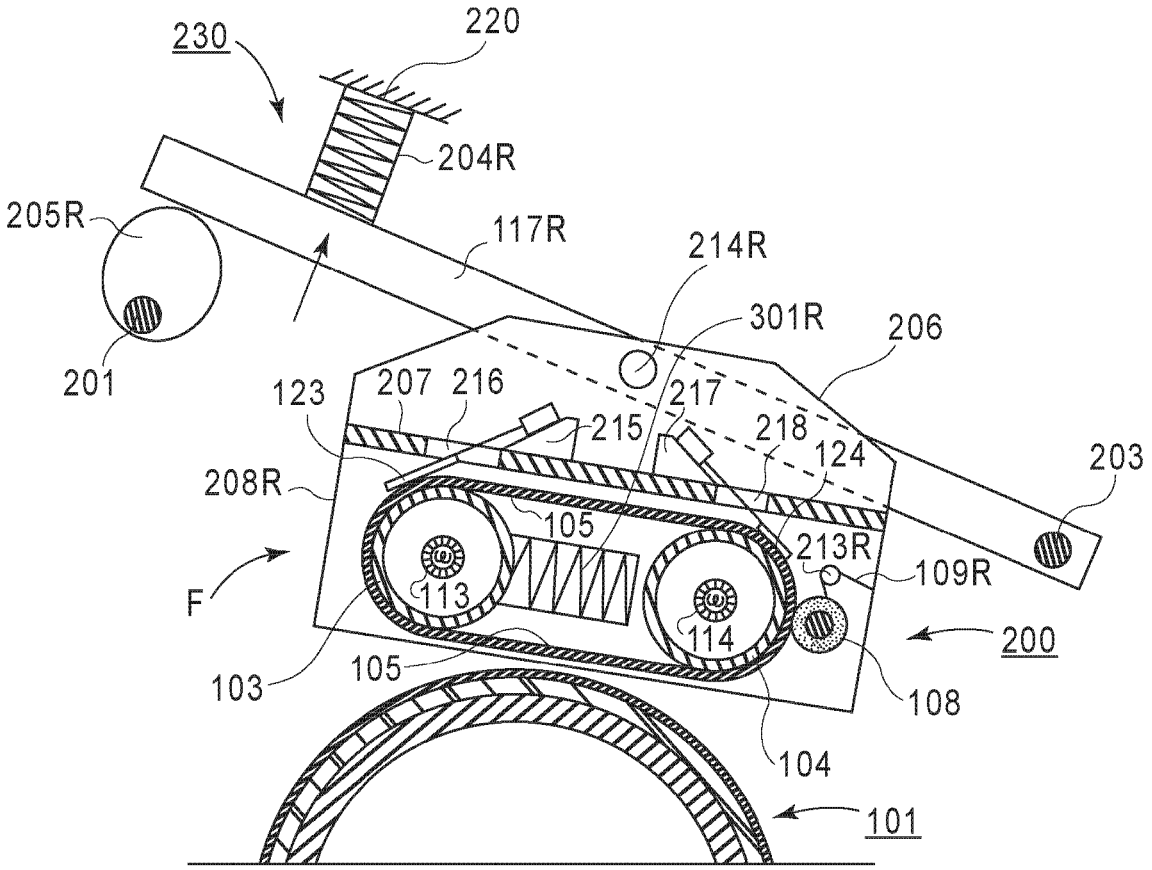
FIG. 3 is a schematic sectional view of the external heating unit when the unit is in the second position (retreat position).
Figure 4:
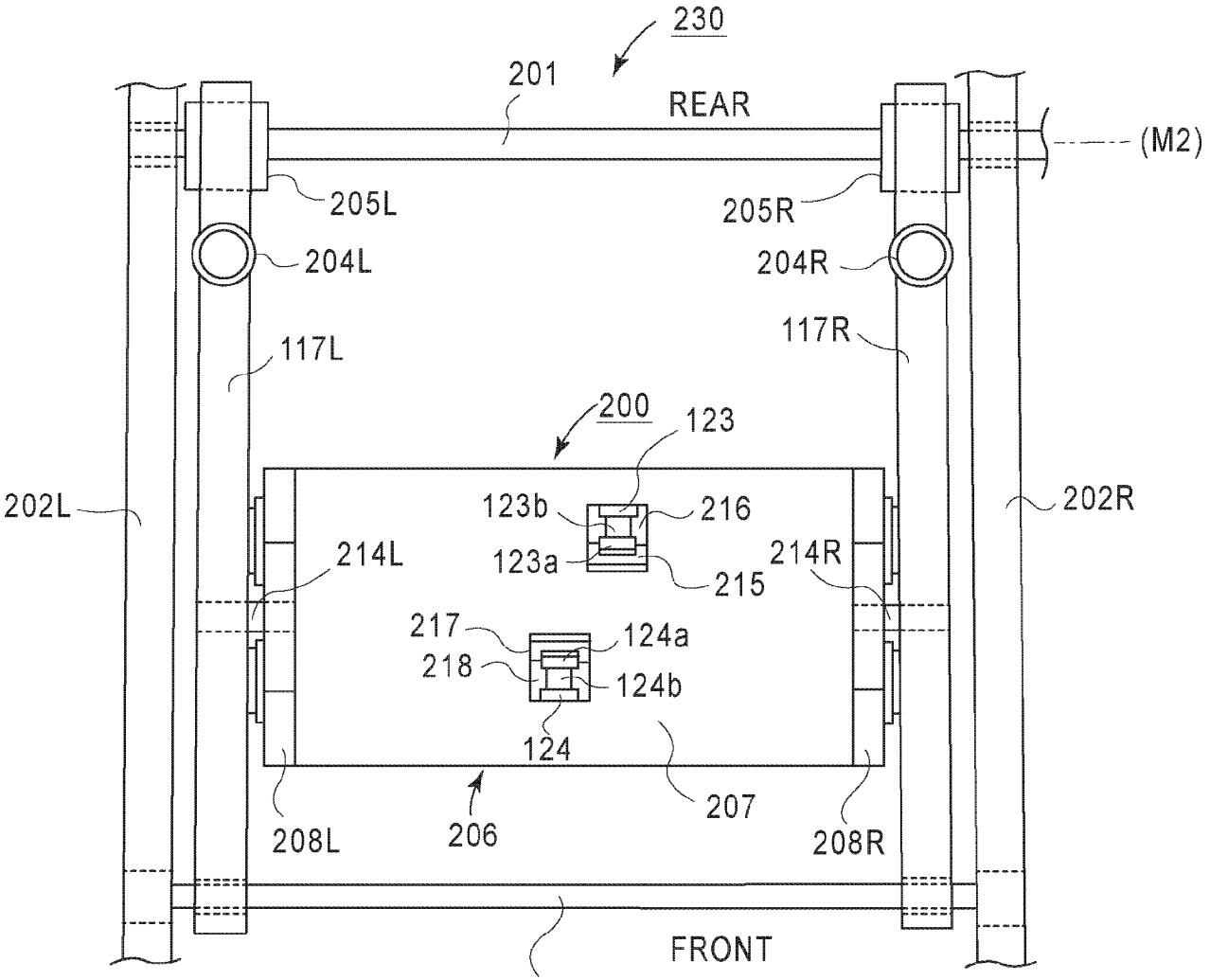
FIG. 4 is a schematic top view of a combination of the external heating unit and the mechanism for moving the heating unit.
Figure 6:
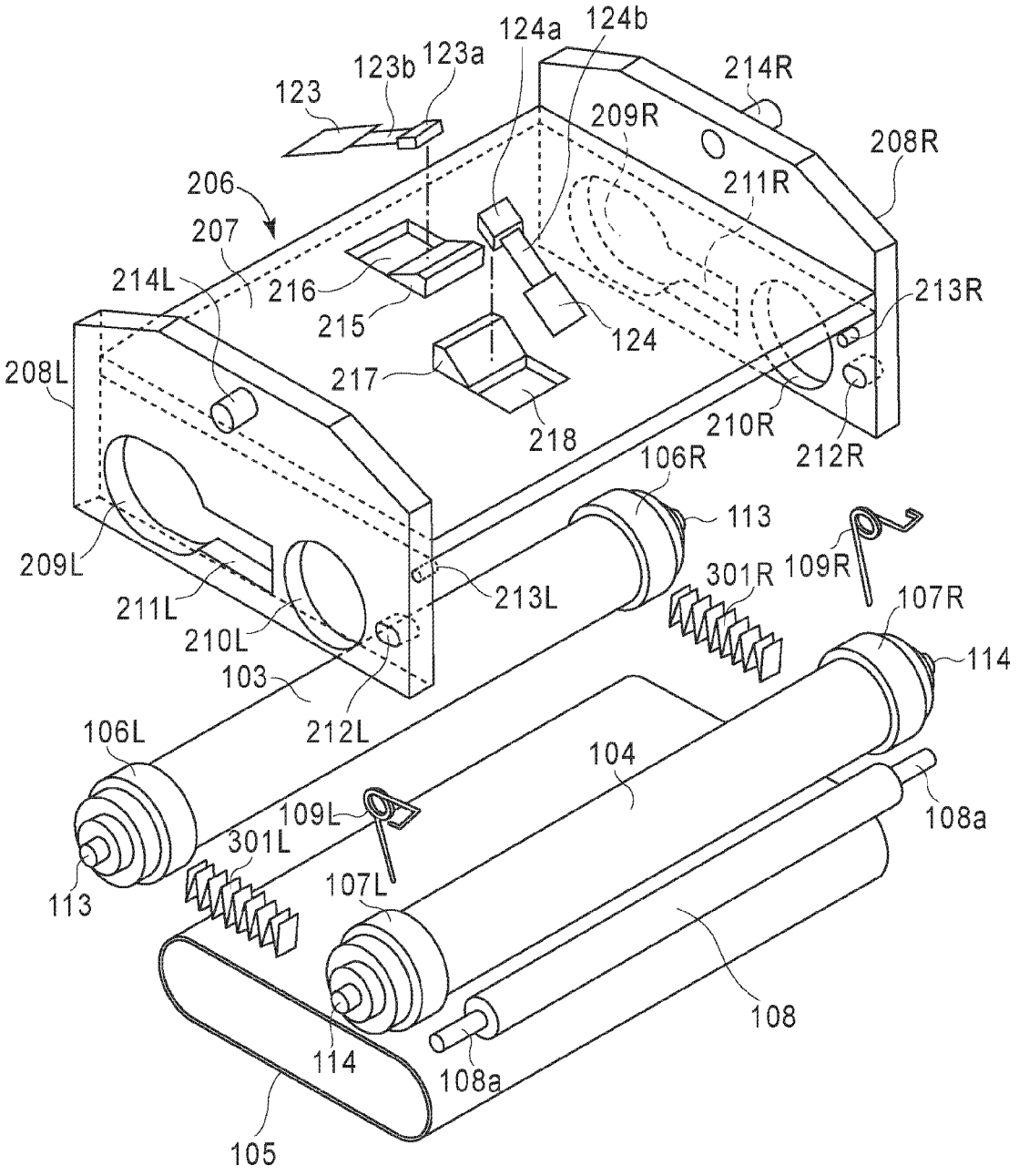
FIG. 6 is an exploded perspective view of the external heating unit.

Referring to FIGS. 1 and 3, the external heating unit 200 is disposed on the top side of the fixation roller 101 by the external heating unit moving mechanism 230. FIG. 4 is a plan view (top view) of the combination of the external heating unit 200, and the moving mechanism 230 by which the external heating unit 200 is held. FIG. 6 is an exploded perspective view of the external heating unit 200.

The external heating unit 200 in this embodiment has an external heating belt 105, which externally heats the fixation roller 101. It has also the first and second heat rollers 103 and 104, which rotatably support the external heating belt 105, from within the loop which the external heating belt 105 forms, and also, press the external heating belt 105 toward the fixation roller 101. Moreover, it has a pair of compression springs 301L and 301R, as pressure applying members, which keep the first heat roller 103 pressed in the direction to move the first heat roller 103 away from the second heat roller 104.

Further, the external heating unit 200 has a unit frame 206, which rotatably supports the first and second heat rollers 103 and 104, in such a manner that allows the first heat roller 103 to move relative to the second heat roller 104 against the pressure generated by the compression springs 301L and 301R. Further, it has a thermistor 123, as a temperature detection element, which detects the temperature of the external heating belt 105. The thermistor 123 is disposed in such a manner that the external heating belt 105 remains sandwiched by the first heat roller 103 and thermistor 123.

The above-mentioned structural components of the external heating unit 200 are attached to the unit frame 206 as a holding mechanism. The unit frame 206 has: a flat plate 207, the lengthwise direction of which coincides with the left-right direction; and a pair of lateral plates 208L and 208R which are fixed to the left and right ends of the flat plate 207, and the lengthwise direction of which coincides with the front-rear direction.

The left and right lateral plates 208L and 208R are provided with the first pair of bearing holes 209L and 209R, and the second pair of bearing holes 210L and 210R, which are symmetrically positioned with reference to a vertical plane which coincides with the center of the external heating unit 200 and is parallel to the lateral plates 208L and 208R. The first pair of bearings 209L and 209R are in the rear portions of the lateral plates 208L and 208R, respectively, in terms of the front-rear direction. They are such long holes that their lengthwise direction coincides with the front-rear direction. The second pair of bearing holes 210L and 210R are in the front portions of the lateral plates 208L and 208R, respectively, in terms of the front-rear direction, with the provision of a preset distance from the first pair of bearing holes 209L and 209R, respectively. They are round holes.

There are provided a pair of long holes 211L and 211R between the first pair of bearing holes 209L and 209R, and the second pair of bearing holes 210L and 210R, respectively. The lengthwise direction of the pair of long holes 211L and 211R coincides with the front-rear direction. These long holes 211L and 211R are in connection to the first pair of bearing holes 209L and 209R, respectively. There are also provided the third pair of long bearing holes 212L and 212R, on the front side of the second pair of bearing holes 210L and 210R, respectively. The lengthwise direction of the third pair of long bearing holes 212L and 212R coincides with the front-rear direction. The third pair of long bearing holes 212L and 212R are smaller than the second pair of bearing holes 210L and 210R.

There are provided a pair of pin shafts 213L and 213R, which are attached to the inward surfaces of the lateral plates 208L and 208R, on the top sides of the third pair of long bearing holes 212L and 212R, respectively. Further, there are provided a pair of shafts 214L and 214R, which are attached to the top portions of the outward surfaces of the lateral plates 208L and 208R, being positioned roughly in the center of the lateral plate, in terms of the front-rear direction, respectively.

The top surface of the flat plate 207 is provided with a pair of thermistor seats 215 and 217. In terms of the lengthwise direction of the flat plate 207, the thermistor seats 215 and 217 are at roughly the center of the flat plate 207. In terms of the widthwise (front-rear) direction of the flat plate 207, the thermistor seats 215 and 217 are positioned closer to the rear and front ends, respectively, of the flat plate 207. There is provided a thermistor insertion hole 216, in the immediate adjacencies of the rear side of the thermistor seat 215. Further, there is provided a thermistor insertion hole 218, in the immediate adjacencies of the front side of the thermistor seat 217.

The first heat roller 103 is in the form of a piece of metallic pipe. There is a halogen heater 113, as a heat source, in the hollow of the first heat roller 103. The first heat roller 103 is rotatably supported between the lateral plates 208L and 208R of the unit frame 206, by their lengthwise ends, with the placement of a pair of bearings 106L and 106R between the lengthwise ends of the first heat roller 103 and lateral plates 208L and 208R, respectively.

The bearings 106L and 106R are fitted in the first bearing holes 209L and 209R of the lateral plates 208L and 208R, respectively, in such a manner that they do not come out of the bearing holes 209L and 209R, respectively. The bearings 106L and 106R are allowed to slide in the front-rear direction while being guided by the first bearing holes 209L and 209R, respectively, the lengthwise direction of which coincide with the front-rear direction. That is, the first heat roller 103 is allowed to move in the front-rear direction, between the lateral plates 208L and 208R, while remaining parallel to the second heat roller 104.

The second heat roller 104 also is a piece of metallic pipe. There is a halogen heater 114, as a heat generating member, in the hollow of the second heat roller 104. The second heat roller 104 is rotatably supported between the lateral plates 208L and 208R of the unit frame 206, by their lengthwise ends, with the placement of a pair of bearings 107L and 107R between the lengthwise ends of the second heat roller 104 and lateral plates 208L and 208R, respectively.

The bearings 107L and 107R are fitted in the second bearing holes 210L and 210R of the lateral plates 208L and 208R, respectively, in such a manner that they do not come out of the bearing holes 210L and 210R, respectively. The bearings 107L and 107R have a round bearing hole. Thus, as the bearings 107L and 107R are fitted into, and locked in, the bearing holes 210L and 210R, they become fixed to the lateral plates 208L and 208R, being thereby prevented from moving relative to the lateral plates 208L and 208R. That is, the second heat roller 104 is rotatably supported by the lateral plates 208L and 208R, but is not allowed to move relative to the lateral plates 208L and 208R.

In this embodiment, the external heating belt 105 has a metallic (stainless, nickel, or the like) or resinous (PI, or the like) layer as a substrate. In order to prevent toner from adhering to the external heating belt 105, the substrative layer is covered with a layer of heat resistant fluorinated resin, which reduces the external heating belt 105 in friction. The external heating belt 105 is an endless and flexible belt. It is suspended between the first and second heat rollers 103 and 104.

The external heating unit 200 is provided with a pair of compression springs 301L and 301R, which are fitted in the long holes 211L and 211R of the lateral plates 208L and 208R, in such a manner that they remain compressed. The compression springs 301L and 301R are formed of a long and narrow springy plate. They are shaped so that their cross section look like the cross section of the wall of a bellows. Thus, the bearings 106L and 106R remain under the pressure generated by the resiliency of the compressed compression springs 301L and 301R in the direction to cause the bearings 106L and 106R to slide rearward, following the first bearing holes 209L and 209R, the lengthwise direction of which coincides with the front-rear direction.

That is, the compression springs 301L and 301R keep the first heat roller 103 pressed in the direction to move the first heat roller 103 away from the second heat roller 104. Thus, the first heat roller 103 functions as a tension roller which provides the external heating belt 105 with tension, between the first and second heat rollers 103 and 104.

A referential code 108 stands for a cleaning roller for cleaning the surface of the external heating belt 105. The cleaning roller 108 is rotatably supported between the lateral plates 208L and 208R. More concretely, the left and right ends of a shaft 108*a* of the cleaning roller 108, the rotational axis of which coincides with that of the cleaning roller 108, are fitted in the third bearing holes (elongated holes) 212L and 212R of the lateral plates 208L and 208R, respectively, of the unit frame 206.

The cleaning roller 108 is always under a preset amount of pressure generated by the left and right torsion springs 109L and 109R as pressure applying means. Thus, it remains pressed upon the surface of the external heating belt 105, in the area in which the external heating belt 105 is suspended by the second heat roller 104. It is rotated by the rotational movement of the external heating belt 105. The area in which the external heating belt 105 is suspended by the second heat roller 104 is the area of contact between the second heat roller 104 and external heating belt 105.

The torsion springs 109L and 109R are held by the pair of pin shaft 213L and 213R, with which the lateral plates 208L and 208R of the unit frame 106 are provided, respectively. The torsion springs 109L and 109R are anchored to the lateral plates 208L and 208R, by one of their arm portions, whereas the other arm portion is placed in contact with the corresponding end of the roller shaft 108*a*. Thus, the cleaning roller 108 remains pressed upon the external heating belt 105.

The thermistor 123 is cantilevered to the flat plate 207. More concretely, the leaf spring portion 123*b* of thermistor 123 is attached to the base portion 123*a* of the thermistor 123, and the base portion 123*a* is attached to the flat plate 207. The thermistor 123 is inserted, from the heat sensing element side, into the unit frame 206, from above, through the hole 216 of the flat plate 207 of the unit frame 206, toward the area in which the external heating belt 105 is suspended by the first heat roller 103. Then, the base portion 123*a* of the thermistor 123 is attached to the thermistor anchor 215. The area in which the external heating belt 105 is suspended by the first heat roller 103 coincides with the area of contact between the external heating belt 105 and first heat roller 103. Thus, the thermistor 123 is made to remain in contact with the surface of the external heating belt 105 by the resiliency of the leaf spring 123*b*, in the adjacencies of the area of contact between the external heating belt 105 and first heat roller 103.

As described above, the thermistor 123 detects the temperature of the external heating belt 105 by being disposed in such manner that the external heating belt 105 remains sandwiched by the thermistor 123 and first heat roller 103.

The thermistor 124 is cantilevered to the flat plate 207. More concretely, the leaf spring portion 124*b* is attached to the base portion 124*a* of the thermistor 124, and the base portion 124*a* is attached to the flat plate 207. The thermistor 124 is inserted into the unit frame 206, from above, through the hole 218 of the flat plate 207 of the unit frame 206, toward the area in which the external heating belt 105 is suspended by the second roller 104. Then, the base portion 124*a* of the thermistor 124 is attached to the thermistor anchor 217. The thermistor 124 is kept elastically in contact with the surface of the external heating belt 105 by the resiliency of the leaf spring 124*b*, in the area in which the external heating belt 105 is suspended by the second heat roller 104.

As described above, the thermistor 124 is disposed in such a manner that the external heating belt 105 remains sandwiched by the thermistor 124 and second heat roller 104, and detects the temperature of the external heating belt 105.

(4) Moving Mechanism 230

The moving mechanism 230 is such a mechanism that places the external heating belt 105 in contact with, or moving the external heating belt 105 away from, the fixation roller 101. That is, it is a mechanism for moving the external heating unit 200 in such a manner that the external heating unit 200 can be placed in the first position E (FIG. 1) in which it keeps the external heating belt 105 in contact with the fixation roller 101, or the second position in which it keeps the external heating belt 105 separated from the fixation roller 101.

Referring to FIG. 4, the moving mechanism 230 has a shaft 203 which is between the front portions of the left and right lateral plates 202L and 202R of the fixing device frame. The moving mechanism 230 has also left and right pressure arms 117L and 117R, which are pivotally movable about the shaft 203. The left and right pressure arms 117L and 117R extend from the front side of the lateral plates 202L and 202R toward the rear side.

Further, the moving mechanism 230 has: a cam shaft 201 rotatably supported by a pair of bearings, between the lateral plates 202L and 202R; and left and right cams 205L and 205R which are the same in shape and are fixed to the cam shaft 201 so that they become the same in rotational phase. The cam shaft 201 is disposed so that the left and right cams 205L and 205R are positioned on the bottom side of the free ends of the left and right pressure arms 117L and 117R, respectively.

Further, the moving mechanism 230 is provided with a pair of compression springs 204L and 204R, which are disposed between the top surfaces of the free end portions of the pressure arms 117L and 117R, and the stationary members 220 of the casing of the fixing device 9, in such a manner that they remain compressed. Therefore, the pressure arms 117L and 117R remain pressed toward the fixation roller 101 in such a manner that they are allowed to pivotally move about the shaft 203.

The external heating unit 200 is held by the roughly middle portions of the left and right pressure arms 117L and 117R, in terms of the lengthwise direction, in such a manner that they are allowed to pivotally move relative to the arms 117L and 117R, about the shafts 214L and 214R with which the left and right lateral plates 208L and 208R of the unit frame 206 are provided.

The cams 105L and 105R rotate with the cam shaft 201. As the cams 105L and 105R rotate, they pivotally move the pressure arms 117L and 117R upward or downward about the shaft 203, causing thereby the external heating belt 105 of the external heating unit 200 to come into, or move away from, the fixation roller 101.

As the driving force from a motor M2, as a driving force source, is transmitted to the cam shaft 201, the cams 105L and 105R are rotated into the first position, in terms of their rotational direction, in which the largest radius portion of each cam faces downward as shown in FIG. 1, and then, the second position, in which the largest radius portion of each cam faces upward as shown in FIG. 3, for every half turn. The motor 21 drives, or stops driving, the cam shaft 201 as the motor driver 142 is turned on or off by the motor controller 141 which is controlled by the control section 140. With the employment of a half rotation clutch mechanism, it is possible to control the cam shaft 210 so that as the motor controller 141 is turned on by the control section 140, the cams 105L and 105R rotate by half a full turn, as described above.

As the cam shaft 201 is rotated into the first angle, the largest radius portion of each of the cams 105L and 105R faces downward as shown in FIG. 1. Thus, the cams 105L and 105R remain separated from the pressure arms 117L and 117R. When the cams 105L and 105R are in the state shown in FIG. 1, the external heating unit 200 is in its first position E in which the bottom portion of the external heating belt 105 remains in contact with the fixation roller 101, between the first and second heat rollers 103 and 104.

Also when the cams 105L and 105R are in the state shown in FIG. 1, the unit frame 106 of the external heating unit 200 is under the force (pressure) generated by the resiliency of the compression springs 204L and 204R which are remaining compressed by the pressure arms 117L and 117R. Thus, the unit frame 106 of the external heating unit 200 is under the pressure generated by the resiliency of the compression springs 204L and 204T. Therefore, the first and second heat rollers 103 and 104, by which the external heating belt 105 is suspended, remain pressed against the fixation roller 101.

Therefore, the bottom portion of the external heating belt 105 suspended between the first and second heat rollers 103 and 104 remain pressed toward the fixation roller 101. Thus, it remains in contact with the peripheral surface of the fixation roller 101 in a manner to conform to the curvature of the fixation roller 101, forming thereby area of contact Ne (FIG. 1) having a preset width.

The above-mentioned bottom portion of the external heating belt 105 is made to give inward of the loop which the external heating belt 105 forms, because of the curvature of the peripheral surface of the fixation roller 101, against the belt tension. Therefore, the first heat roller 103, as a tension roller, moves toward the second heat roller 104 against the resiliency of the compression springs 301L and 301R.

Figure 7:
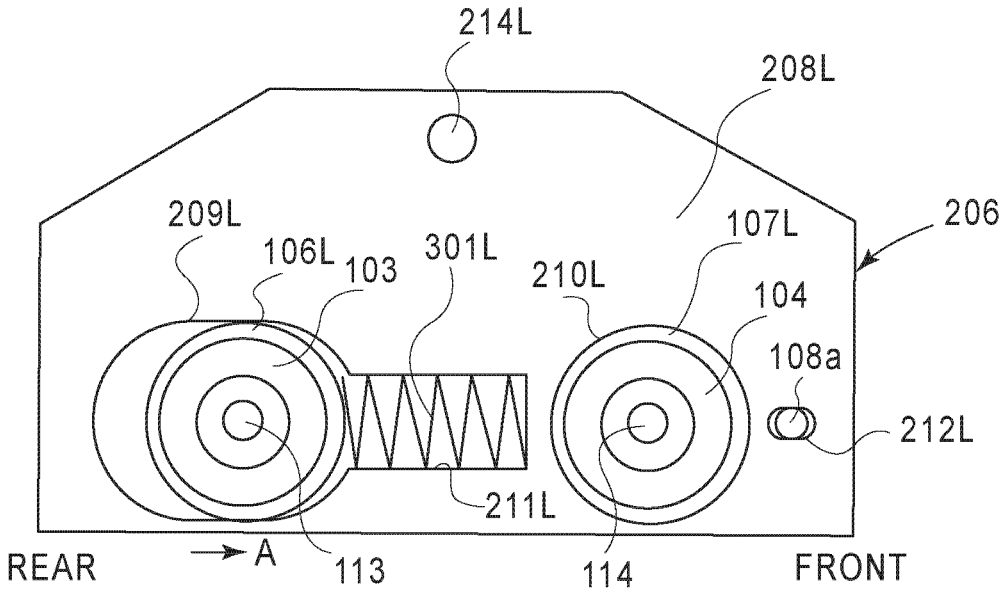
FIG. 7 is a left side view of the external heating unit.
Figure 7:
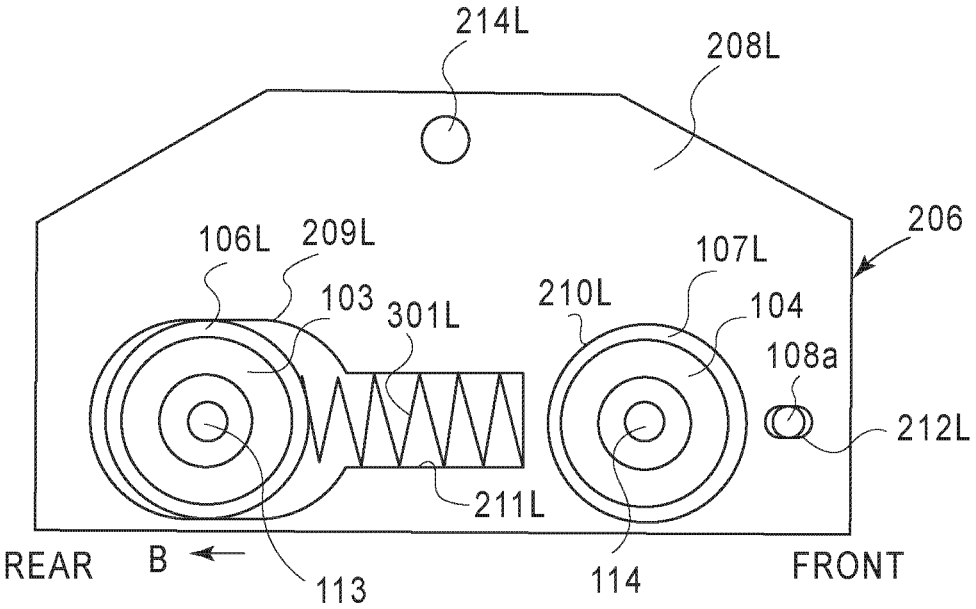

Referring to FIG. 7(*a*), the first heat roller 103 is moved frontward against the resiliency of the compression springs 301L and 301R in the direction indicated by an arrow mark A, with the bearings 106L and 106R following the first bearing holes 209L and 209R, the lengthwise direction of which coincides with the front-rear direction. Although FIG. 7(*a*) shows the movement of only the left bearing 106L, the movement of the right bearing 106R is the same as that of the left bearing 106L.

That is, when the external heating unit 200 is moved in the direction to place the external heating belt 105 in contact with the fixation roller 101, the second heat roller 104 does not move relative to the unit frame 106. In comparison, the first heat roller 103, as a tension roller, is held by the left and right bearings 106L and 106R fitted in the first bearing holes 209L and 209R, the lengthwise direction of which coincides with the front-rear direction, in such a manner that they are movable in the front-rear direction. Therefore, the first heat roller 103 is movable relative to the unit frame 106 in the front-rear direction. Thus, as the external heating unit 200 is moved toward the fixation roller 101 to place the external heating belt 105 in contact with the fixation roller 101, the first heat roller 103 moves toward the second heat roller 104, allowing thereby the external heating belt 105 to move into the position in which it forms the area of contact Ne having the preset width, between the fixation roller 101 and itself, by airtightly contacting the peripheral surface of the fixation roller 101.

It has to ensured that the external heating belt 105 remains airtightly in contact with the peripheral surface of the fixation roller 101 and forms, and maintains, the nip having the preset width, between itself and fixation roller 101, as described above. Therefore, the compression springs 204L and 204R are employed to keep the external heating unit 200 pressed toward the fixation roller 101.

As the fixation roller 101 is rotationally driven while the external heating belt 105 is airtightly in contact with the fixation roller 101 as described above, the external heating belt 105 is rotated by the rotation of the fixation roller 101 in the counterclockwise direction indicated by an arrow mark in FIG. 1. Thus, the first and second heat rollers 103 and 104 are rotated by the rotation of the external heating belt 105. Further, the cleaning roller 108 also is rotated by the rotation of the external heating belt 105.

The first and second heat rollers 103 and 104 are internally heated. More concretely, as electric power is supplied to the halogen heaters 113 and 114 in the heat rollers 103 and 104, respectively, from the heater driver 144 through the electric power line (unshown), the halogen heaters 113 and 114 (heat sources) generate heat. Thus, the first and second rollers 103 and 104 are internally heated. Thus, the external heating belt 105 is heated by the heat from the first and second heat rollers 103 and 104 heated internally by the halogen heaters 113 and 114.

The surface temperature of the external heating belt 105 heated by the first and second heat rollers 103 and 104 is detected by the thermistors 123 and 124. Electrical information related to the temperature detected by the thermistors 123 and 124 is inputted into the control section 140.

The control section 140 controls the amount by which electric power is supplied to the heater 113, by turning on or off the heater driver 144 through the heater controller 143 so that the surface temperature of the external heating belt 105, which is detected by the thermistor 123, increases to a target level, and remains at the target level. Further, the control section 140 controls the amount by which electric power is supplied to the heater 114, by turning on or off the heater driver 144 through the heater controller 143 so that the surface temperature of the external heating belt 105, which is detected by the thermistor 124, increases to a target level, and remains at the target level.

Thus, the peripheral surface of the fixation roller 101 is externally heated by the external heating belt 105 which is in contact with the fixation roller 101. The target level for the temperature of the external heating belt 105 is set to be higher than the target level for the surface temperature of the fixation roller 101. Therefore, as the fixation roller 101 reduces in surface temperature because of its contact with a sheet P of paper in the fixation nip N, heat is quickly (at high level of thermal response) supplied to the fixation roller 101 from the external heating belt 105.

Further, as the cam shaft 201 is rotated into the second position in terms of its rotational direction, the largest radius portion of each of the cams 105L and 105R points upward. Thus, the left and right pressure arms 117L and 117R are pivotally moved upward about the shaft 203 against the resiliency of the compression springs 204L and 204R. Thus, the external heating unit 200 is moved upward away from the fixation roller 101, into the second position F, in which it keeps the bottom portion of the external heating belt 105 separated from the fixation roller 101.

During this movement of the external heating unit 200, the first heat roller 103 is under the pressure generated by the compression springs 301L and 301R in the direction to move the first heat roller 103 away from the second heat roller 104. That is, the first heat roller 103 is functioning as a tension roller. Therefore, as the external heating belt 105 is moved away from the fixation roller 101, the first heat roller 103, more specifically, the bearings 106L and 106R, move rearward in the direction indicated by an arrow mark B, following the first bearing holes 209L and 209R, the lengthwise direction of which coincides with the front-rear direction, as shown in FIG. 7(*b*). Thus, the slack of the external heating belt 105 is taken up. FIG. 7(*b*) shows the movement of only the left bearing 106L. However, the movement of the right bearing 106R is the same as that of the left bearing 106L.

That is, the external heating belt 105 is given such tension that is parallel to the lines which are tangential to both the first and second heat rollers 103 and 104, as shown in FIG. 3. Thus, it is possible to reduce the distance by which the external heating unit 200 has to be moved away from the fixation roller 101 to ensure that the external heating belt 105 remains separated from the fixation roller 101. In this embodiment, the external heating unit 200 is structured so that the second heat roller 104 is fixed in position, whereas the first heat roller 103 is movable in position.

The employment of the above described structural arrangement makes it possible to improve the external heating belt 105 in terms of the airtightness between the external heating belt 105 and fixation roller 101 when the external heating belt 105 has to be in contact with the fixation roller 101. Further, it can reduce the distance by which the external heating unit 200 has to be moved away from the fixation roller 101 to keep the external heating belt 105 separated from the fixation roller 101.

(5) Fixing Operation

Figure 5:
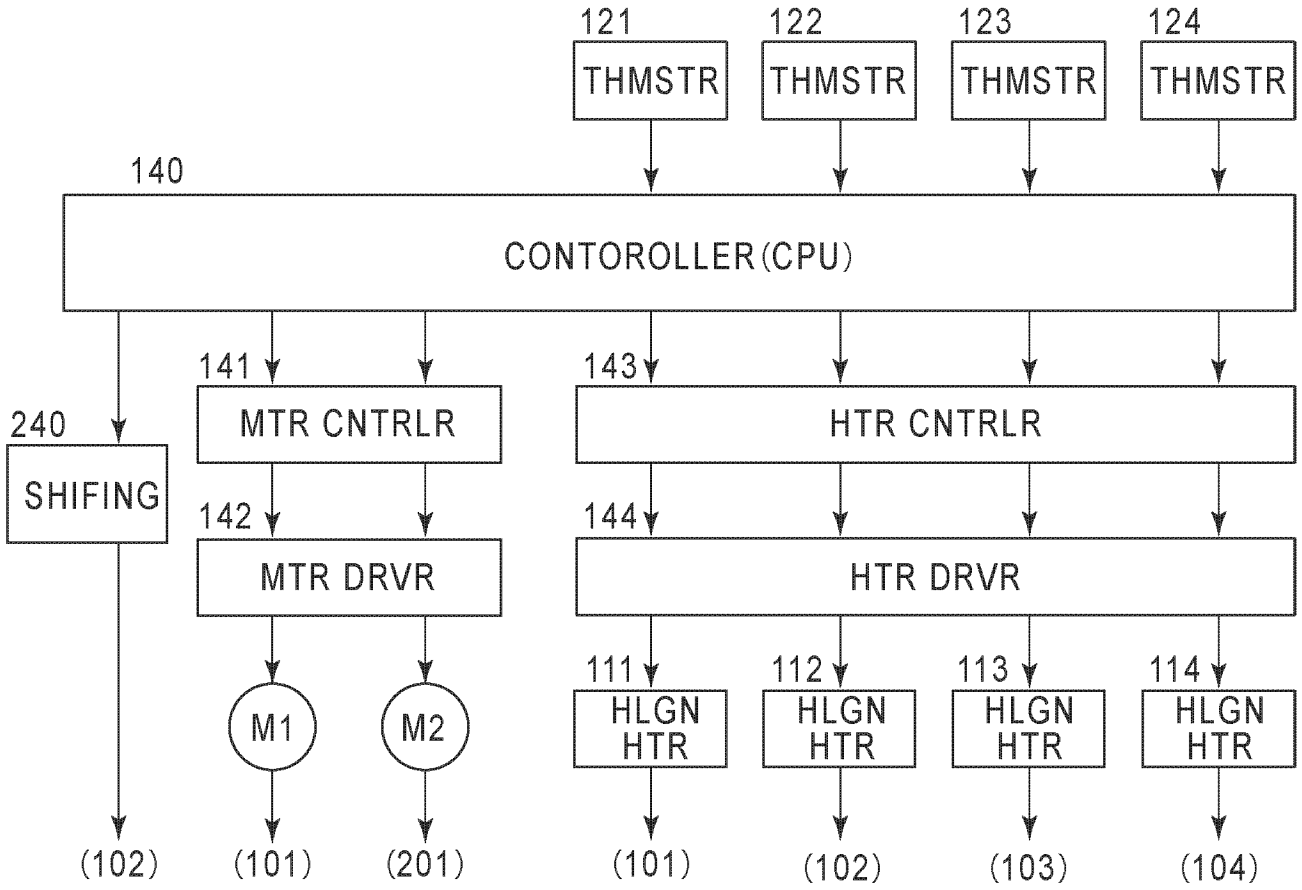
FIG. 5 is a block diagram of the control system.
Figure 8:
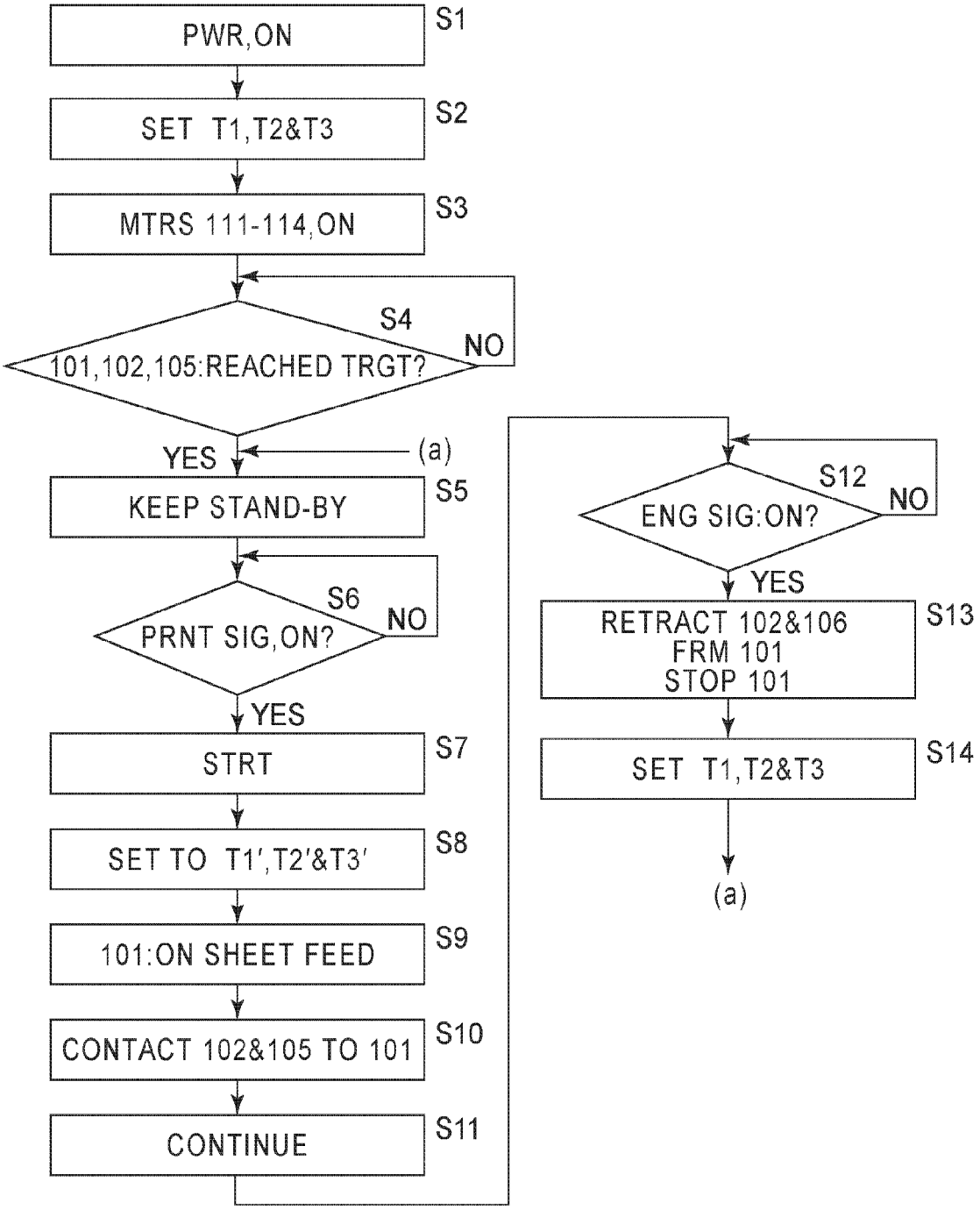
FIG. 8 is a flowchart of the fixing operation of the fixing device.

Next, the fixing operation of the fixing device 9 is described with the use of the flowchart in FIG. 8, and the block diagram of the control sequence in FIG. 5. When the electrical power source of the image forming apparatus 50 is off, the fixation roller 101 is kept stationary, and the pressure roller 102 is kept separated from the fixation roller 101. Further, the external heating unit 200 remains separated from the fixation roller 101. Moreover, electric power is supplied to none of the halogen heaters 111-114.

As the electric power source of the image forming apparatus 50 is turned on (Step 1), the target temperature levels (T1, T2 and T3) for the fixation roller 101, pressure roller 102, and external heating belt 105 are set by the control section 140 (S2). Then, electric power begins to be supplied to the halogen heaters 111, 112, 113 and 114 to heat the fixation roller 101, pressure roller 102, first heat roller 103, and second heat roller 104, respectively, while the fixation roller 101, pressure roller 102, and external heating belt 105 are adjusted in temperature (S3, S4).

The above-mentioned target temperature levels (T1, T2 and T3) are set according to the type of the sheet of paper used for image formation. For example, the information regarding the type of the sheet of paper used by a user is inputted through the control panel 250 of the image forming apparatus 50. Then, the control section 140 obtains the information regarding the sheet of paper to be subjected to the fixing operation, by detecting the information with the use of the recording medium type detecting means. Then, the control section 140 sets the target temperature level for each of the members 101, 102, 103 and 104, based on the obtained information regarding the sheet of paper. Then, the control section 140 makes adjustments based on the temperature levels obtainable from the thermistors 121, 122, 123 and 124.

As each of the members 101, 102 and 105 reaches its target temperature level, the control section 140 controls each of the halogen heaters 111, 112, 113 and 114 so that the temperature of each of the members 101, 102 and 105 remains at its target level (T1, T2 or T3) (control section 140 keeps the fixing device 9 on standby) (S5). Then, as the control section 140 receives a print signal (S6), it makes the image forming apparatus 50 start an image formation job (S7). As the printing operation starts, the target levels for the members 101, 102, and 105 are switched to the target levels (T1', T2' and T3') which correspond to the recording medium (sheet) type. Then, the members 101, 102 and 105 are adjusted in temperature, based on the temperatures obtained through the thermistors 121, 122, 123 and 124, respectively (S8).

Then, the driving of the fixation roller 101, and the feeding of sheets P of paper, are started (S9). During the image forming operation, the fixation roller 101 is driven at a preset peripheral velocity. The pressure roller 102 is kept in contact with the fixation roller 101 by the operation of the shifting mechanism 240, and the external heating unit 200, more specifically, the external heating belt 105, is kept in contact with the fixation roller 101 by the operation of the moving mechanism 230 (S10). The pressure roller 102 and external heating belt 105 are rotated by the rotation of the fixation roller 101. That is, when the image forming apparatus 50 is on standby, the external heating belt 105 remains separated from the fixation roller 101, and therefore, it remains stationary.

While the image forming apparatus 1 is in the above described state, a sheet P of paper, which is bearing an unfixed toner image, is conveyed to the fixing device 9 from the image forming section side, and is introduced into the fixation nip N of the fixing device 9, to fix the unfixed toner image to the sheet P. This fixing operation carried out by the fixing device 9 is continued until the control section 140 receives a printing operation ending signal (S11). As the image forming job ends (S12), the pressure roller 102 is separated from the fixation roller 101 by the operation of the shifting mechanism 230. Further, the external heating unit 200, more specifically, the external heating belt 105, is made to move away from the fixation roller 101, by the moving mechanism 230. Then, the driving of the fixation roller 101 is stopped (S13).

Then, the target temperature levels (T1, T2 and T3) for the fixation roller 101, pressure roller 102, and external heating belt 105 are reset, and the members 101, 102, and 105 are adjusted in temperature, based on the temperatures obtained from the thermistors 121, 122 and 123, respectively (S14).

Until the control section 140 receives the next print signal, it keeps the fixing device 9 in the above described state (standby) (S5). Incidentally, the above described control sequence may be modified so that when the fixing device 9 is kept on standby, it is rotationally driven at a speed which is slower than the speed at which it is driven while images are actually formed.

(6) Temperature Detection Element

Figure 9:
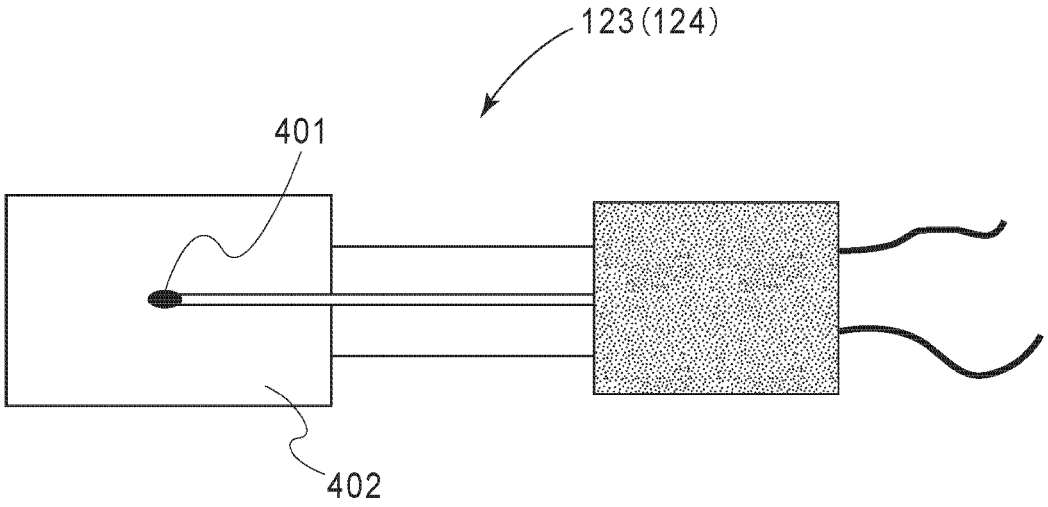
FIG. 9 is a schematic drawing of the thermistor, and shows the structure of the thermistor.

Next, the structure of the thermistors 123 (124), as temperature detection elements, which are placed in contact with the surface of the external heating belt 105 to be used by the control section 140 to keep the surface temperature of the external heating belt 105 at a preset target level is shown in FIG. 9. A thermistor is such a resistor that changes in electrical resistance by a very large amount in response to changes in temperature. That is, it changes in electrical resistance value in response to temperature increase. Therefore, the change in the electrical resistance value of a thermistor can be converted into the change in temperature. Thus, a thermistor can be used to measure the temperature of an object.

In terms of size and shape, there are various thermistor elements. Generally speaking, however, the higher the thermistor elements are in terms of accuracy, the smaller (no more than 1 mm) they are. The thermistor 401 in this embodiment is attached to a thin metallic plate 402 made of stainless steel, phosphor bronze, or the like, with the use of adhesive. It is kept in contact with an object with the use of the resiliency of the thin metallic plate 402, to measure the electrical resistance value of the thermistor element 401 through the thin metallic plate 402 to obtain the temperature of the object. This structural arrangement is well known.

In a case where a thermistor is structured so that it is placed in contact with an object, the thermistor element 401 of the thermistor is extremely small relative to the metallic plate 402 of the thermistor, as shown in FIG. 9. Therefore, the amount by which thermistor 401 changes in electrical resistance value is affected by where the point of contact between the thermistor element 401 and object is relative to the metallic plate 402. Thus, the temperature level detected by the thermistor becomes different from the actual temperature of the object.

For example, regarding the positional relationship among the thermistor 123 (124), object 403, and point of contact between the thermistor 123 (124) and object, the external heating unit 200 is changed in the position of the point of contact between the thermistor 123 and object 403, and the values of the temperature of the object 403 detected by the thermistor 123 while the temperature of the object 403 is kept at 200° C., are compared. Regarding the position of the point of contact between the thermistor 123 (124) and external heating belt 105, the point of contact which is directly below the thermistor element 401 is referred to as position 0, or the point of reference. FIG. 11 shows the relationship between the distance (positional deviation) from the position 0 to the actual point of contact, and the value of the temperature level detected by the thermistor.

Referring to FIG. 11, in a case where the positional deviation of the point of contact from the thermistor element 401 is no more than roughly 0.5 mm, the difference between the actual temperature of the object 403 and the value of the temperature level detected by the thermistor 123 (124) is no more than 1° C. In comparison, in a case where the positional deviation of the point of contact from the thermistor 123 (124) is 1 mm, the actual temperature of the object 403 and the value of the temperature level detected by the thermistor 123 (124) becomes roughly 4° C.

As described above, the greater the amount of the positional deviation of the point of contact between the thermistor 123 (124) and object 403 from the position 0, the lower the temperature detected by the thermistor. Further, it is also evident from FIG. 11 that the pattern in which the temperature detected by the thermistor 123 declines roughly in proportion to the distance of the point of contact between the thermistor 123 and object 403 from the position 0, on the upstream side of the position 0 in terms of the rotational direction of the object 403, is symmetrical to that on the downstream side. Moreover, the greater the distance of the point of contact between the thermistor 123 and object 403, from the thermistor element 401, the greater the amount of difference (rate of decline) of the temperature detected by the thermistor 123 (124) from the actual temperature of the object 403, and also, the detected temperatures wary widely.

Figure 12:
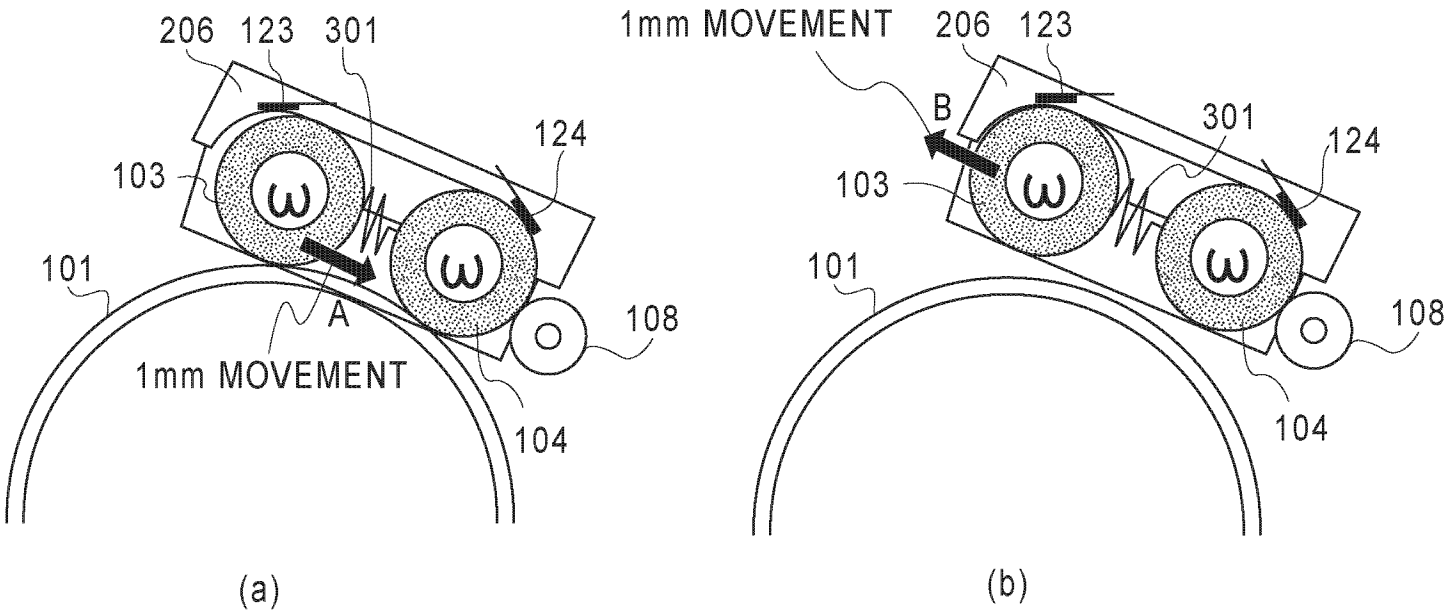
FIG. 12 is a drawing which shows the movement of the first heat roller, which occurs as the external heating belt is moved to be placed in contact with the fixation roller, and the movement of the first heat roller, which occurs as the external heating belt is moved to be separated from the fixation roller.

In the case of the fixing device 9 in this embodiment, the first heat roller 103 of the external heating unit 200 functions as a tension roller. Further, as the external heating unit 200 is moved toward the fixation roller 101, this first heat roller 103 moves by roughly 1 mm in the direction indicated by the arrow mark A, that is, toward the second heat roller 104. Moreover, as the external heating belt 105 is moved away from the fixation roller 101, the first heat roller 103 moves away from the second heat roller 104, which is fixed in position, that is, in the direction indicated by the arrow mark B as shown in FIG. 12(*b*), which is a schematic drawing.

Figure 13:
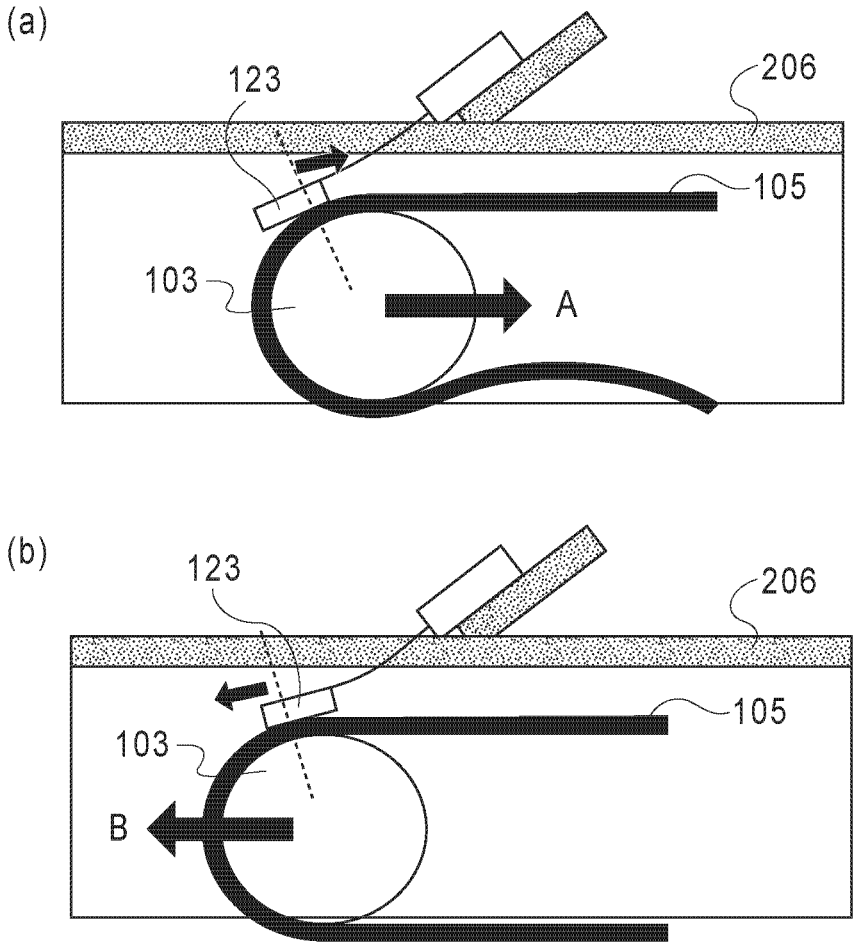
FIG. 13 is a drawing which shows the movement of the first heat roller, which occurs as the external heating belt is moved to be placed in contact with the fixation roller, and the movement of the first heat roller, which occurs as the external heating belt is moved to be separated from the fixation roller.

Therefore, as the external heating belt 105 is moved toward the fixation roller 101, the point of contact between the external heating belt 105 and thermistor 123 moves toward the thermistor base as shown in FIG. 13(*a*) which is also a schematic drawing. On the other hand, as the external heating belt 105 is moved away from the fixation roller 101, the point of contact between the external heating belt 105 and thermistor 123 moves away from the base portion of the thermistor 123 as shown in FIG. 13(*b*) which is a schematic drawing.

Because the external heating unit 200 is structured as described above, when the external heating belt 105 is in full contact with the fixation roller 101, and the point of contact between the external heating belt 105 and thermistor 123 is directly below the thermistor element 401, the temperature detected by the thermistor 123 is virtually equal to the actual surface temperature of the external heating belt 105. However, when the external heating belt 105 is in its retreat position, the temperature detected by the thermistor 123 is substantially lower than the actual temperature of the external heating belt 105.

Therefore, the control section 140 turns on the halogen heater 113 to increase the temperature of the external heating belt 105 to the target temperature level T3 for the standby period. Consequently, the surface temperature of the external heating belt 105 becomes substantially higher than the target temperature level T3. Thus, if the state of the external heating unit 200 changes as described above, and the external heating belt 105 comes into contact with the fixation roller 101 immediately after the starting of the printing operation, the surface temperature of the fixation roller 101 is higher than the optimal level for fixation. Therefore, the image defect called "hot offset" occurs, which is a phenomenon that the toner image on a sheet P of paper excessively melt, offsets onto the fixation roller 101, and soils the image to be fixed.

Further, for example, in a case where the external heating belt 105 is in its separation position, that is, being in separation from the fixation roller 101, and the point of contact between the surface of the thermistor 123 and external heating belt 105 is directly below the thermistor element 401, the temperature detected by the thermistor 123 is very close to the actual temperature of the peripheral surface of the fixation roller 101. In comparison, in a case where the external heating belt 105 is its contact position, that is, being fully in contact with the fixation roller 101, the temperature detected by the thermistor 123 is substantially lower than the actual temperature of the external heating belt 105.

Therefore, the control section 140 turns on the halogen heater so that the surface temperature of the external heating belt 105 will increase to, and remain at, the target temperature level T3' during a printing operation. Consequently, the surface temperature of the external heating belt 105 becomes substantially higher than the target temperature level T3'. Thus, the amount by which the external heating belt 105 gives to the fixation roller 101 by being placed in contact with the fixation roller 101 during a continuous printing operation becomes larger than the preset amount (intended amount). Consequently, the surface temperature of the fixation roller 101 gradually increases, resulting in the occurrence of "hot offset" during the continuous printing operation.

Figure 14:
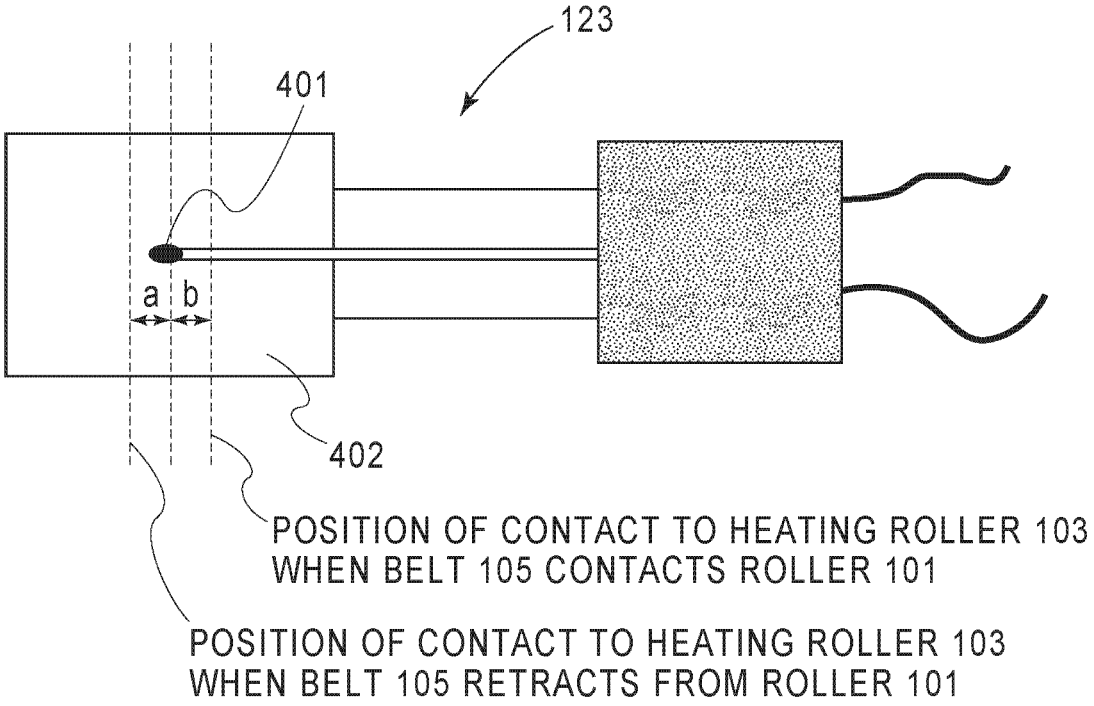
FIG. 14 is a drawing which shows the portion of the thermistor, by which the thermistor is in contact with the external heating belt when the external heating belt 105 is in full contact with the fixation roller, and that when the external heating belt is in its retreat position.

Therefore, the external heating unit 200 is structured so that the distance between the point of the thermistor 123, by which the thermistor 123 contacts the external heating belt 105 when the external heating belt 105 is in its retreat position, and the point of the thermistor 123, which corresponds to the position of the thermistor element 401, becomes equal to that when the external heating belt 105 is in its contact position, as shown in FIG. 14. That is, the external heating unit 200 is structured so that a distance a becomes equal to a distance b in FIG. 14.

That is, the thermistor 123 is positioned so that the temperatures detected by the thermistor 123 when the external heating belt 105 is in the first and second positions E and F while the temperature of the external heating belt 105 is maintained at a preset level, become higher than those when the external heating belt 105 is between the first and second positions E and F, or the thermistor 123 is positioned so that its point which is highest in sensitivity, that is, the point which corresponds to the thermistor element 401, contacts the external heating belt 105 when the external heating belt 105 is between the first and second positions E and F.

With the external heating unit 200 being structured as described above, it is possible to prevent the point of the thermistor 123, by which the thermistor 123 contacts the external heating belt 105 when the external heating belt 105 is its contact position, and the point of the thermistor 123, by which the thermistor 123 contacts the external heating belt 105 when the external heating belt 105 is its retreat position, from substantially deviating from the point of the thermistor 123, which is directly below the thermistor element 401. Therefore, it is possible to minimize the deviation of the temperature detected by the thermistor 123 from the actual temperature of the surface of the external heating belt 105 when the external heating belt 105 is in its contact position, and when the external heating belt 105 is in its retreat position.

Therefore, it is possible to keep the surface temperature of the external heating belt 105 adjusted extremely close to the target level both when the external heating belt 105 is in its contact position, or in its retreat position. In other words, it is possible to reliably control the external heating belt 105 in surface temperature. Further, it is possible to keep the surface temperature of the fixation roller 101 adjusted to the preset level (intended level), and therefore, it is possible to prevent the occurrence of "hot offset" or the like image defects.

Next, a method for verifying whether or not the fixing device 9 is structured as described above is described. First, the fixing device 9 is to be removed from the main assembly of the image forming apparatus 50. Next, it is to be made possible for the motor for placing the external heating unit 200 in contact with, or separating the external heating unit 200 from, the fixation roller 101, to be externally driven to rotate the gear train for placing the external heating unit 200 in contact with the fixation roller 101, or separating the external heating unit 200 from the fixation roller 101, or for the gear train to be manually rotated.

Then, the gear train of the external heating unit 200 is to be rotated to move the external heating belt 105 into the retreat position, in which the external heating belt 105 is kept separated from the fixation roller 101. During this process, the distance between the first and second heat rollers 103 and 104 is to be measured. Then, the gear train of the external heating unit 200 is to be rotated to place the external heating belt 105 in its contact position, in which it keeps the external heating unit 200 keeps the external heating belt 105 fully in contact with the fixation roller 101. Then, the distance between the first and second heat rollers 103 and 104 is to be measured.

Next, the external heating unit 200 is to be removed from the fixing device 9. Then, a component to which the first and second heat rollers 103 and 104 can be attached in such a manner that the distance between the first and second heat rollers 103 and 104 can be varied.

Further, such a structural arrangement is to be made to enable the thermistors 123 and 124 to be externally used while being kept in contact the external heating belt 105. Further, a thermocouple which is capable of remaining in contact with the first and second heat rollers 103 and 104 while the first and second heat rollers 103 and 104 are moved is to be attached, in addition to the thermistors 123 and 124. Further, it is to be made possible for the halogen heaters 113 and 114 in the heat rollers 103 and 104 of the external heating unit 200 to be externally controllable based on the temperature detected by the thermocouple which are in contact with the heat rollers 103 and 104.

It is checked whether or not a temperature value Tc that makes the temperatures detected by the thermistors 123 and 124 which are in contact with the heat rollers 103 and 104 which are being controlled so that they remain stable in temperature at a preset level, satisfy the following relationship, exists.

$$Ta \leq Tc \geq Tb$$

Ta stands for the temperature detected when the distance between the first and second heat rollers 103 and 104 corresponds to when the external heating belt 105 is fully in contact with the fixation roller 101.

Tb stands for the temperature detected when the distance between the first and second heat rollers 103 and 104 corresponds to when the external heating belt 105 is in its retreat, being therefore positioned farthest from the fixation roller 101.

Then, it is checked whether or not the temperature value Tc which satisfies the above described mathematical formula, exists in the area between the first and second heat rollers 103 and 104 when the external heating belt 105 is fully in contact with the fixation roller 101, and that when the external heat belt 105 is in its retreat position, in which it remains separated from the fixation roller 101.

Figure 15:
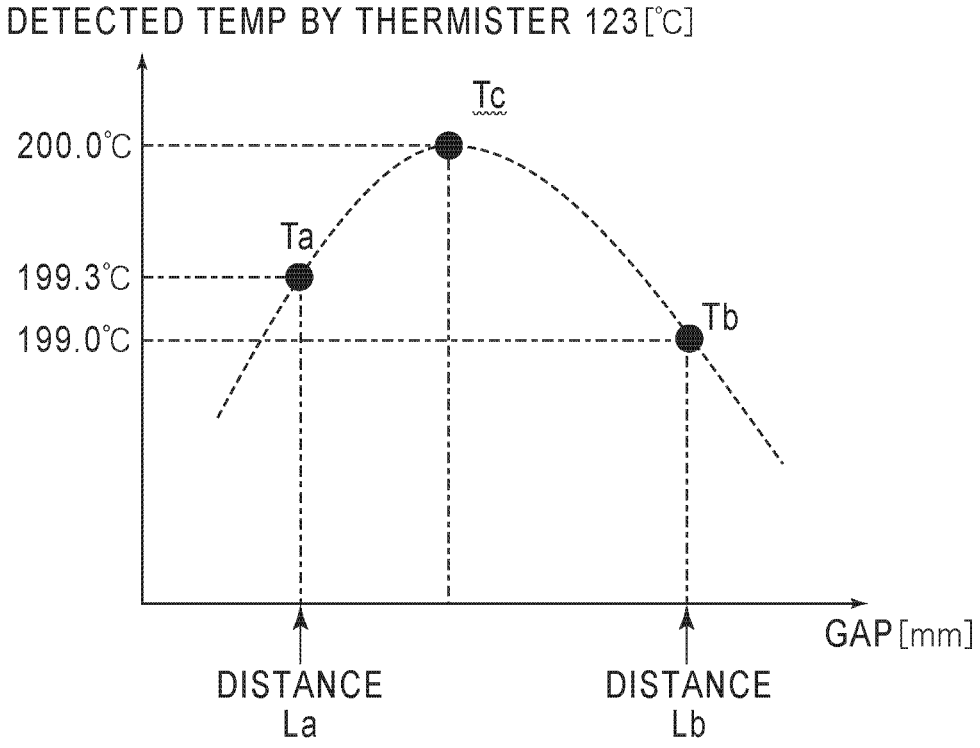
FIG. 15 is a drawing for describing the verifying method.

For example, shown in FIG. 15 is the relationship between the temperature detected by the thermistor 123 and the distance between the two heat rollers 103 and 104 while the halogen heater 113 was controlled so that the temperature detected by the thermocouple which is in contact with the surface of the external heating belt 105 becomes 200° C., in this structural arrangement.

Referring to FIG. 15, the temperature Tb detected by the thermistor 123 fixed between the shaft of the first heat roller 103 and the shaft of the second heat roller 104 when the external heating belt 105 is in its retreat position is 199.0° C. The temperature Ta detected by the thermistor 123 fixed between the shaft of the first heat roller 103 and the shaft of the second heat roller 104 when the external heating belt 105 is fully in contact with the fixation roller 101 is 199.3° C.

Lb stands for the distance between the first and second heat rollers 103 and 104 when the external heating belt 105 is in its retreat position. La stands for the distance between the shaft of the first heat roller 103 and the shaft of the second heat roller 104 when the external heating belt 105 is its contact position, in which it is fully in contact with the fixation roller 101. It is evident from FIG. 15 that the point at which Tc becomes highest is between where the shaft-to-shaft distance is La and where the shaft-to-shaft distance is Lb. Referring to FIG. 15, the point is where Tc is 200° C.

In the case of the above-described structure, it can be said that the thermistor 123 is positioned as described next. That is, the thermistor 123 is positioned so that while the temperature of the external heating belt 105 is maintained at a preset level, the temperature detected by the thermistor 123 when the external heating belt 105 is in the above described first position, and the temperature detected by the thermistor 123 when the external heating belt 105 is in the above described second position, become higher than the temperature detected by the thermistor 123 when the external heating belt 105 is in the preset position between the first and second positions, or the thermistor 123 is positioned so that its point which is highest in sensitivity, that is, the point which corresponds to the thermistor element 401, contacts the external heating belt 105 when the external heating belt 105 is in a preset position which is between the first and second positions E and F.

This is how it is possible to prevent the temperature detected by the thermistor 123 when the external heating belt 105 is fully in contact with the fixation roller 101, or when the external heat belt 105 is in its retreat position, from becoming substantially different from the actual temperature of the external heating belt 105. Therefore, it is possible to reliably control the external heating belt 105 in temperature.

(7) Temperatures Detected by Thermistor while External Heating Unit is in Various Positions in Terms of Direction in which External Heating Unit is Moved to be Placed in Contact, or Separated from, Fixation Roller When the external heating unit 200 is in its retreat position, in which it is position farthest from the fixation roller 101, the temperature detected by the thermistor 123 are set as follows. That is, the halogen heaters (111, 113 and 114) are controlled by the control section 140 so that the temperature detected by the thermistors 121, 123 and 124 become 180° C. The thermistor 121 detects the temperature of the fixation roller 101. The thermistor 123 detects the temperature of the portion of the external heating belt 105, which corresponds to the first heat roller 103. The thermistor 124 detects the temperature of the portion of the external heating belt 105, which corresponds to the second heat roller 104.

After it is confirmed that the temperature detected by each thermistor is remaining at 180° C. (or in adjacencies of 180° C.), the cams 205 are rotated to place the external heating unit 200 in contact with the fixation roller 101. Then, the changes which occur to the temperature detected by the thermistor 123 are detected during the period in which the cams 205 begin to be rotated, the external heating unit 200 comes into contact with the fixation roller 101, and the external heating belt 105 is placed fully in contact with the fixation roller 101 by the pressure generated by the compression spring 204.

Then, it is checked whether the temperatures detected by the thermistor 123 while the external heating unit 200 which was in its retreat position (second position F) is moved into the contact position (second position E), are higher than the temperatures detected when the external heating unit 200 is fully in contact with, or separated farthest from the fixation roller 101. That is, the thermistor 123 is positioned so that while the temperature of the external heating belt 105 is maintained at a preset level, the temperature detected by the thermistor 123 when the external heating unit 200 is between the position (first position) in which the external heating unit 200 is fully in contact with the fixation roller 101 and the position (second position) in which it is separated farthest from the fixation roller 101, are higher than the temperatures detected by the thermistor 123 when the external heating unit 200 is in its first or and second position. More concretely, the thermistor 123 is positioned so that 189° C. is detected.

The reason why the external heating unit 200 is structured so that the temperature detected by the thermistor 123 while the external heating unit 200 is between its retreat position and contact position (transitional state) becomes higher than those detected when the external heating unit 200 is in its retreat position or contact position is to minimize the temperature fluctuation attributable to the placement of the external heating unit 200 in contact with the fixation roller 101 and the separation of the external heating belt 105 from the fixation roller 101.

Here, it is desired that the temperature detected by the thermistor 123 when the external heating unit 200 is fully in contact with the fixation roller 101 becomes equal to the temperature detected by the thermistor 123 when the external heating belt 105 is in the retreat position. However, due to the tolerance in the accuracy of the components of the external heating unit 200, and the like factors, the distance from the thermistor element 401 to the point of contact between the thermistor 123 and first heat roller 103 when the external heating unit 200 is fully in contact with the fixation roller 101 or when the external heating unit 200 is in its retreat position, is unlikely to be constant, and therefore, the former is likely to be different from the latter. Further, the difference is possibly caused by the inaccuracy with which the thermistor 123 can detect the temperature of the external heating belt 105 at the point of contact between the external heating belt 105 and thermistor 123. In a case where this difference is excessive, the temperature of the first heat roller 103 cannot be reliably controlled. Therefore, it is desired that the external heating unit 200 is structured so that the difference becomes no more than 5° C.

Here, the portion of the thermistor (temperature detection element), which contacts the external heating belt 105 and is integral with the surface, the temperature of which is to be measured, is defined as "temperature detection area". Further, the point of the thermistor, which is in the temperature detection area and is highest in the temperature the thermistor detects, is defined as the center portion of the temperature detection element. Basically, the portion of the thermistor, to which the thermistor element 401 adheres, is the center portion.

Figure 10:
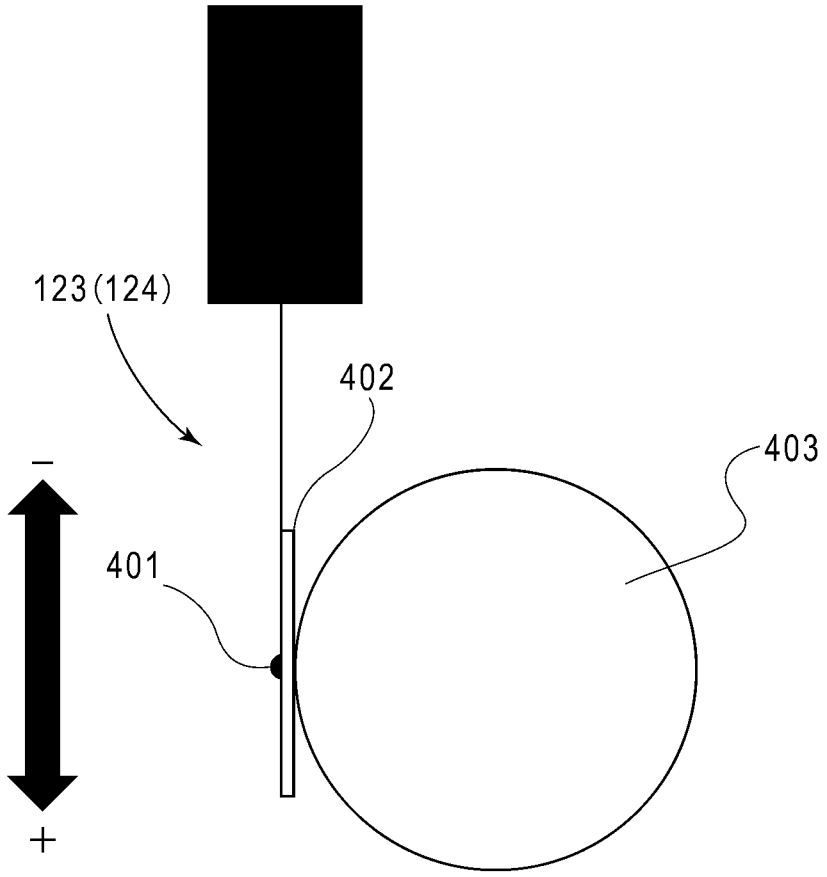
FIG. 10 is a schematic drawing which shows the method for measuring the relationship between the point of an object, which a thermistor contacts, and the temperature detected by the thermistor.

A method to specify the center portion is as follows. An object 403 having curvature as shown in FIG. 10 is heated, and is controlled in temperature so that its temperature detected by a radiation thermometer or the like remains at a preset level (200° C. in this embodiment). The point of the thermistor, which is highest in the temperature detected by the thermistor, is defined as the central point (portions which corresponds to 0 mm in FIG. 11).

Here, regarding the direction in which the external heating unit 200 is placed in contact with, or separated from, the fixation roller 101, while the external heating unit 200 is moved from its retreat position to the contact position (while external heating unit 200 is in transitional period), the thermistor contacts the external heating belt 105 by its center portion (which is highest in sensitivity). On the other hand, when the external heating unit 200 is in its retreat position or contact position, the thermistor contacts the external heating belt 105 by its portion which is different from the center portion of the temperature detection area.

The reason why the portion of thermistor, which contacts the external heating belt while the external heating unit 200 is moved from its retreat position to its contact position (during transitional period) is made higher in temperature detection sensitivity than the portion of the thermistor, which contacts the external heating belt when the external heating unit 200 is in its retreat position or contact position is to minimize the temperature fluctuation attributable to the placement of the external heating unit 200 in contact with the fixation roller 101, and separation of the external heating unit 200 from the external heating belt 105.

In this embodiment, the external heating unit 200 is structured so that in terms of the direction in which the external heating unit 200 is moved from the above described retreat position to the contact position (during transitional period), the thermistor contacts the external heating belt 105 by the center portion (which is highest in detection sensitivity) of its temperature detection area.

Assuming that the external heating unit 200 is structured so that the center portion of the temperature detection area of the thermistor contacts the external heating belt 105 either when the external heating belt 105 is in its retreat position, or in the contact position, in a case where the center portion of the temperature detection area of the thermistor contacts the external heating belt 105, the temperature of the external heating belt 105 can be very accurately detected. However, in other cases, the portion of contact between the thermistor and external heating belt 105 deviates from the center portion of the temperature detection area of the thermistor, due to the tolerance in the measurement of the components of the external heating unit 200.

Referring to FIG. 11, the relationship between the distance from the center of the thermistor to the point of contact between the thermistor and external heating belt, and the difference between the actual temperature of the external heating belt and the temperature detected by the thermistor is not linear. That is, it is evident from FIG. 11 that the greater the distance from the center portion of the thermistor to the area of contact between the thermistor and external heating belt, the greater the difference between the actual temperature of the external heating belt 105 and the temperature detected by the thermistor. Thus, it is desired that the external heating unit 200 is structured so that while the external heating unit is moved from its retreat position to its contact position (during transitional period), the center portion of the temperature detection area of the thermistor, in terms of the direction in which the external heating unit is moved, contacts the external heating belt 105.

[Miscellanies]

1) In the case of the fixing device 9 in the above described embodiment, both the first and second support rollers 103 and 104 were heat rollers, and the halogen heaters 113 and 114 were disposed, as heat sources, in the first and second support rollers 103 and 104. However, it is possible to structure the fixing device 9 so that either the first support roller 103 or second support roller 104 is utilized as a heat roller, and a heat source is placed in the heat roller.

2) The fixing device 9 may be structured so that both the first and second rollers 103 and 104 are utilized as tension rollers, and are kept pressured in the direction to move away from each other.

3) The fixing device 9 may be structured so that the external heating belt 105 is heated by electromagnetic induction.

4) The image heating device in the preceding embodiment was a fixing device for fixing an unfixed toner image K to a sheet P of paper. The embodiment, however, is not intended to limit the present invention in scope. That is, the present invention is also applicable to an apparatus (device) (which also is referred to as fixing apparatus (device)) which applies heat and pressure to a temporarily fixed toner image on a sheet P of paper to improve the image in gloss. The results of the application are similar to those described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 051387/2014 filed Mar. 14, 2014, which is hereby incorporated by reference.

What is claimed is:

1. An image heating apparatus comprising:

(i) first and second rotatable members configured to form a nip for heating a toner image on a recording material therebetween;

(ii) an external heating unit including:

(ii-1) an external heating belt configured to externally heat said first rotatable member;

(ii-ii) first and second supporting rollers configured to (a) rotatably support an inner surface of said external heating belt and (b) urge said external heating belt toward said first rotatable member;

(ii-iii) an urging member configured to urge said first supporting roller in a direction away from said second supporting roller;

(ii-iv) a holding mechanism configured to (a) rotatably hold said first and second supporting rollers and (b) permit relative movement of said first supporting roller relative to said second supporting roller; and (ii-v) a temperature detecting element configured to detect the temperature of said external heating belt; and (iii) a moving mechanism configured to move said external heating unit between a first position in which said external heating belt contacts said first rotatable member and a second position in which said external heating belt is positioned away from said first rotatable member, wherein said temperature detecting element is cantilevered by said holding mechanism so as to interpose said external heating belt between itself and said first supporting roller, by which the positional relationship between said temperature detecting element and said first supporting roller is different between when said external heating unit is in the first position and when said external heating unit is in the second position, and wherein said temperature detecting element is disposed such that in a state that the temperature of said external heating belt is maintained at a predetermined temperature, the detected temperature at a predetermined position between the first position and the second position is higher than the detected temperatures at the first position and the second position.

2. An apparatus according to claim 1, wherein said temperature detecting element is disposed so that the distance between a contact position between said temperature detecting element and said external heating belt in the first position and the position where the detection sensitivity of said temperature detecting element is a maximum is substantially the same as the distance between a contact position between said temperature detecting element and said external heating belt in the second position and the position where the detection sensitivity of said temperature detecting element is the maximum.

3. An apparatus according to claim 1, further comprising a heating source provided inside said first supporting roller and configured to heat said external heating belt, and a controller configured to control electric power supply to said heating source on the basis of an output of said temperature detecting element.

4. An apparatus according to claim 3, wherein said controller controls electric power supply to said heating source on the basis of an output of said temperature detecting element when said external heating unit is in the first position and the second position.

5. An apparatus according to claim 1, wherein said urging member includes a spring.

6. An apparatus according to claim 1, wherein said external heating belt is rotated by said first rotatable member when said external heating belt is in the first position, and said external heating belt is stopped when said external heating unit is in the second position.

7. An image heating apparatus comprising:

(i) first and second rotatable members configured to form a nip for heating a toner image on a recording material therebetween;

(ii) an external heating unit including:

(ii-i) an external heating belt configured to externally heat said first rotatable member;

(ii-ii) first and second supporting rollers configured to (a) rotatably support an inner surface of said external heating belt and (b) urge said external heating belt toward said first rotatable member;

(ii-iii) an urging member configured to urge said first supporting roller in a direction away from said second supporting roller;

(ii-iv) a holding mechanism configured to (a) rotatably hold said first and second supporting rollers and (b) permit relative movement of said first supporting roller relative to said second supporting roller; and (ii-v) a temperature detecting element configured to detect the temperature of said external heating belt; and (iii) a moving mechanism configured to move said external heating unit between a first position in which said external heating belt contacts said first rotatable member and a second position in which said external heating belt is positioned away from said first rotatable member, wherein said temperature detecting element is cantilevered by said holding mechanism so as to interpose said external heating belt between itself and said first supporting roller, by which the positional relationship between said temperature detecting element and said first supporting roller is different between when said external heating unit is in the first position and when said external heating unit is in the second position, and wherein said temperature detecting element is disposed so that a portion of said temperature detecting element where the detection sensitivity thereof is a maximum contacts said external heating belt when said external heating belt is at a predetermined position between the first position and the second position.

8. An apparatus according to claim 7, wherein said temperature detecting element is disposed so that the distance between a contact position between said temperature detecting element and said external heating belt in the first position and the position where the detection sensitivity of said temperature detecting element is a maximum is substantially the same as the distance between a contact position between said temperature detecting element and said external heating belt in the second position and the position where the detection sensitivity of said temperature detecting element is the maximum.

9. An apparatus according to claim 7, further comprising a heating source provided inside said first supporting roller configured to heat said external heating belt, and a controller configured to control electric power supply to said heating source on the basis of an output of said temperature detecting element.

10. An apparatus according to claim 9, wherein said controller controls electric power supply to said heating source on the basis of an output of said temperature detecting element when said external heating unit is in the first position and the second position.

11. An apparatus according to claim 7, wherein said urging member includes a spring.

12. An apparatus according to claim 7, wherein said external heating belt is rotated by said first rotatable member when said external heating unit is in the first position, and said external heating belt is stopped when said external heating unit is in the second position.

* * * * *